US005451984A

United States Patent [19]

Takamiya et al.

[11] Patent Number: 5,451,984

[45] Date of Patent: Sep. 19, 1995

[54] THERMAL TRANSFER RECORDING METHOD AND THERMAL TRANSFER RECORDING DEVICE BY USE OF SAID METHOD

[75] Inventors: Makoto Takamiya, Kawasaki; Kosuke Yamamoto, Yokohama; Hitoshi Kishino, Kawasaki; Nobuyuki Kuwabara, Tokyo; Yasuyuki Tamura, Yokohama; Tadashi Yamamoto, Kawasaki; Haruhiko Takahashi, Yokohama, all of Japan

[73] Assignee: Canon Kabushiki Kaisha, Tokyo, Japan

[21] Appl. No.: 16,672

[22] Filed: Feb. 11, 1993

Related U.S. Application Data

[63] Continuation of Ser. No. 721,918, Jun. 21, 1991, abandoned, which is a continuation of Ser. No. 334,671, Apr. 7, 1989, abandoned.

[30] Foreign Application Priority Data

| | | | |
|---|---|---|---|
| Apr. 12, 1988 | [JP] | Japan | 63-088213 |
| Jul. 28, 1988 | [JP] | Japan | 63-186878 |
| Sep. 5, 1988 | [JP] | Japan | 63-220321 |

[51] Int. Cl.[6] ..... B41J 17/10

[52] U.S. Cl. ..... 347/217; 400/241; 400/241.1

[58] Field of Search ..... 346/76 PH; 400/120, 400/241, 241.1

[56] References Cited

U.S. PATENT DOCUMENTS

| | | | |
|---|---|---|---|
| 4,134,696 | 1/1979 | Hanakata et al. | 346/76 PH |
| 4,396,308 | 8/1983 | Applegate et al. | 400/120 |
| 4,429,318 | 1/1984 | Kobata | 346/76 PH |
| 4,746,933 | 5/1988 | Asakura | 346/76 PH |
| 4,781,481 | 11/1988 | Nagahamaya | 400/120 |
| 4,784,502 | 11/1988 | Kobayashi | 400/120 |
| 4,831,387 | 5/1989 | Sakaguchi et al. | 400/120 |
| 5,072,238 | 12/1991 | Takamiya et al. | 346/76 PH |
| 5,199,805 | 4/1993 | Kawazoe et al. | 346/76 PH |

FOREIGN PATENT DOCUMENTS

| | | |
|---|---|---|
| 0143178 | 6/1986 | Japan . |
| 0169684 | 7/1987 | Japan . |
| 62-299046 | 12/1987 | Japan . |
| 63-309493 | 12/1988 | Japan . |

*Primary Examiner*—Huan H. Tran

*Attorney, Agent, or Firm*—Fitzpatrick, Cella, Harper & Scinto

[57] ABSTRACT

A heat transfer recording device which performs recording by heating a heat transfer medium to transfer the ink possessed by the heat transfer medium onto an image-receiving medium, thereby effecting recording on the image-receiving medium. The device having: a platen; a recording head having a plurality of heat-generating elements capable of heat generating; and a pressing member for pressing the recording head against the platen under a pressing force of 800 gf/cm to 3500 gf/cm.

22 Claims, 15 Drawing Sheets

THERMAL TRANSFER RECORDING METHOD AND THERMAL TRANSFER RECORDING DEVICE BY USE OF SAID METHOD

This application is a continuation of application Ser. No. 07/721,918, filed Jun. 21, 1991, now abandoned, which is a continuation of application Ser. No. 07/334,671 filed Apr. 7, 1989, also abandoned.

BACKGROUND OF THE INVENTION

1. Field of the Invention

This invention relates to a heat or thermal transfer recording method and a heat or thermal transfer recording device by use of said method which can record good images on an image-receiving medium. Particularly, the present invention relates to a heat transfer recording method by use of said method which can record good images even on an image-receiving medium with low smoothness.

Here, the present invention is preferably applicable to, for example, the word processor, electronic typewriter, copying machine, printer and facsimile machine, etc.

2. Related Background Art

Today, various recording systems have been developed as the device for outputting inputted informations, and representative of such systems is the heat transfer recording system.

This recording system comprises generally presses an ink ribbon coated with a heat transferable ink composed mainly of a wax and a recording paper against a platen by a recording head. And, under this state, said recording head is permitted to generate heat selectively to melt the heat transferable ink coated on the ink sheet, thereby effecting transfer recording onto the recording paper. Accordingly, the above heat transfer recording system has compact size and lightweight as well as excellent low noise characteristic, and therefore has been widely used as the output device for word processors, electronic typewriters, etc.

In the above heat transfer recording system, image quality differs depending on the smoothness of the recording paper, and particularly when a recording paper with low smoothness such as rough paper, etc. is used, the edge portion of the transferred image may not always be transferred sharply.

Accordingly, in ordinary recording, the pressing force by a recording head is set at about 500 gf/cm or lower, but it has been considered to increase the head pressure when recording is effected on a rough paper as mentioned above. However, if the above head pressure is made higher, there have been involved such tasks that the melted ink may expanded by the high head pressure to appear sometimes as blurring of the recorded image or the melted ink may be penetrated deep into the paper fibers of the recording paper to make sometimes recording density insufficient, etc.

For this reason, in the heat transfer recording system, it has been difficult to set the head pressure by the recording head at said 500 gf/cm or higher.

Thus, in the above heat transfer recording system image quality differs depending on the smoothness of the recording paper, and particularly when a recording paper with low smoothness such as rough paper, etc. is used, the edge portion of the transferred image may not always be transferred sharply. Accordingly, as the ribbon to cope with a rough paper, it has been considered to use an ink ribbon coated with an ink composed mainly of a material having relatively higher melt viscosity such as a resin, etc. in place of wax.

However, the above ink composed mainly of a resin, etc. has generally strong film strength and is easily elongated, and therefore defects may be formed on the recorded image, or the image edge may not be sharply cut, which results in inferior reproducibility of fine portions of images. For improving the reproducibility of fine portions of images, it is preferable to strengthen the ribbon pressing force at the recording head, and also to peel off quickly the ink ribbon from the recording paper after heating at the heat-generating element.

For that purpose, the ink ribbon must be peeled off from the recording paper at the substrate edge of the recording head, and as shown in FIG. 22, the distance $d_1$ from the heat generating element array H to the edge of the substrate S must be made shorter. However, between the above heat-generating element array H to the edge of the substrate S, there is generally provided a common electrode E for current passage to the heat-generating element array H with a thickness of 1 to 2 μm, and if the distance at this portion is made too short, the voltage effect will occur when passing current through a large number of heat-generating elements, and at the same time variance in quantity of heat generated may occur depending on the number of the heat-generating elements subjected to current passage, whereby there is a fear that the image quality becomes unstable.

On the other hand, when the head pressure is made too high, if the pressing force length l1 of the recording head RH against the platen P in the heat-generating element array direction is longer than the width l2 of the ink ribbon I as shown in FIG. 23, the recording head RH coming out from the width direction of the ink ribbon I will squeeze the recording paper RS under a high pressure, whereby there is a fear that the recording paper RS may be damaged.

SUMMARY OF THE INVENTION

An object of the present invention is to provide a heat transfer recording method and a heat transfer recording device by use of said method which can record good images on an image-receiving medium.

Another object of the present invention is to provide a heat transfer recording method and a heat transfer recording device by use of said method which can record good images even on an image-receiving medium with low smoothness.

Still another object of the present invention is to provide a heat transfer recording method and a heat transfer recording device by use of said method which can record good images even on an image-receiving medium with low smoothness by setting the head pressure at a high level.

Still another object of the present invention is to provide a heat transfer recording method and a heat transfer recording device by use of said method which can make extension of ink smaller and also can record images substantially without generation of image defect, etc. and with good reproducibility at the edge portion.

Still another object of the present invention is to provide a record correcting device and a record correcting method which can correct a recorded image by completely peeling it off by making said head pressure higher.

Still another object of the present invention is to provide a heat transfer recording device which can also record sharp images even by use of an ink composed mainly of a resin.

DESCRIPTION OF THE PREFERRED EMBODIMENTS

Figure 1:
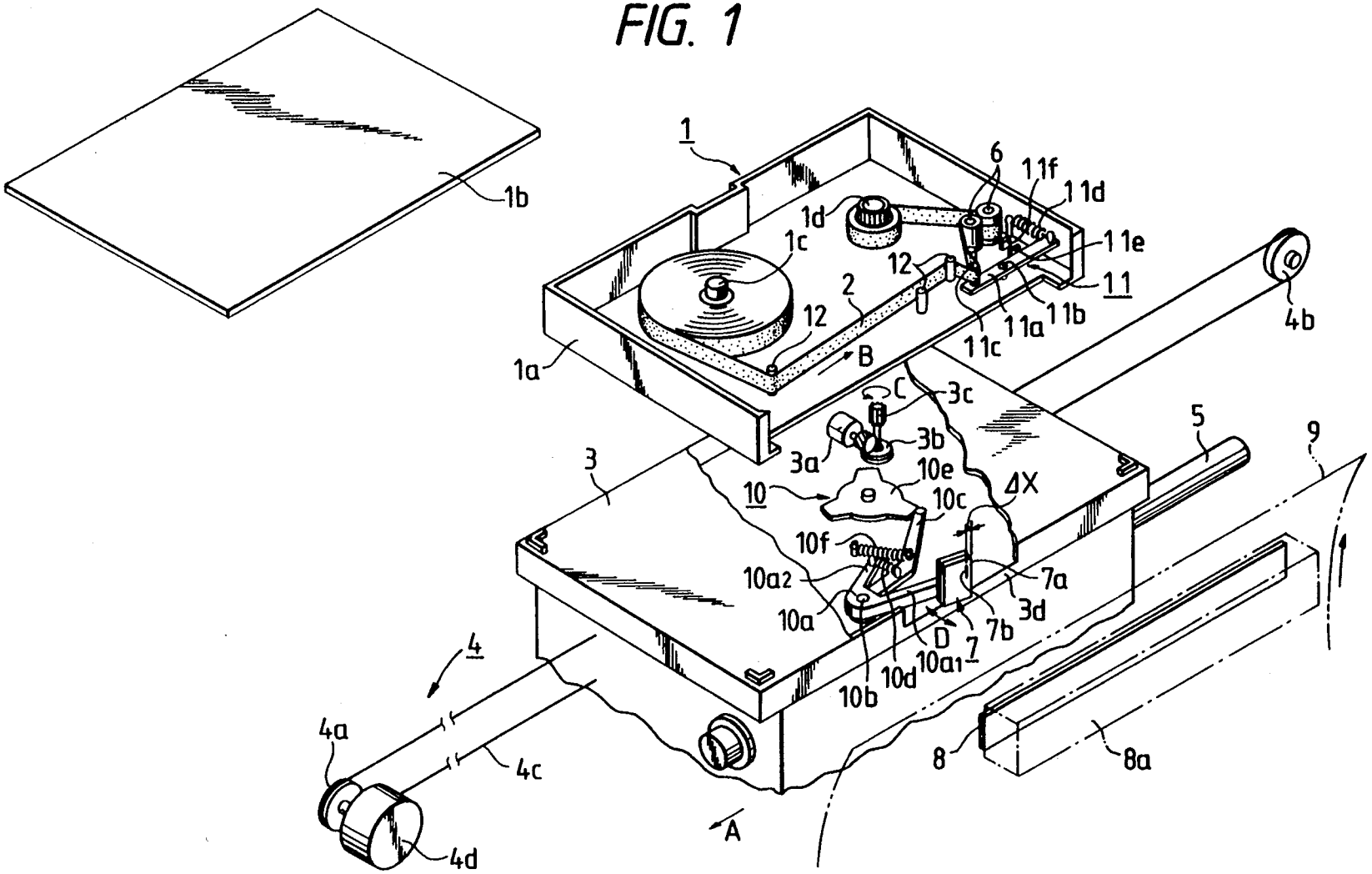
FIG. 1 is a perspective view for illustration of the heat transfer recording device according to an embodiment of the present invention.

Referring now to the drawings, an embodiment in which the above means is applied to the serial type heat transfer recording system is to be described.

First Embodiment

Figure 2:
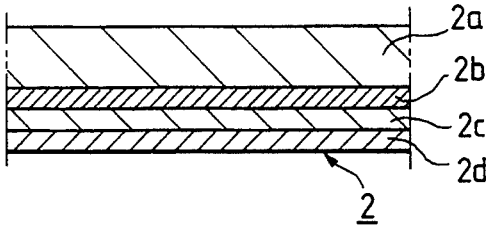
FIG. 2 is an illustration of the construction of the ink ribbon.
Figure 3A:
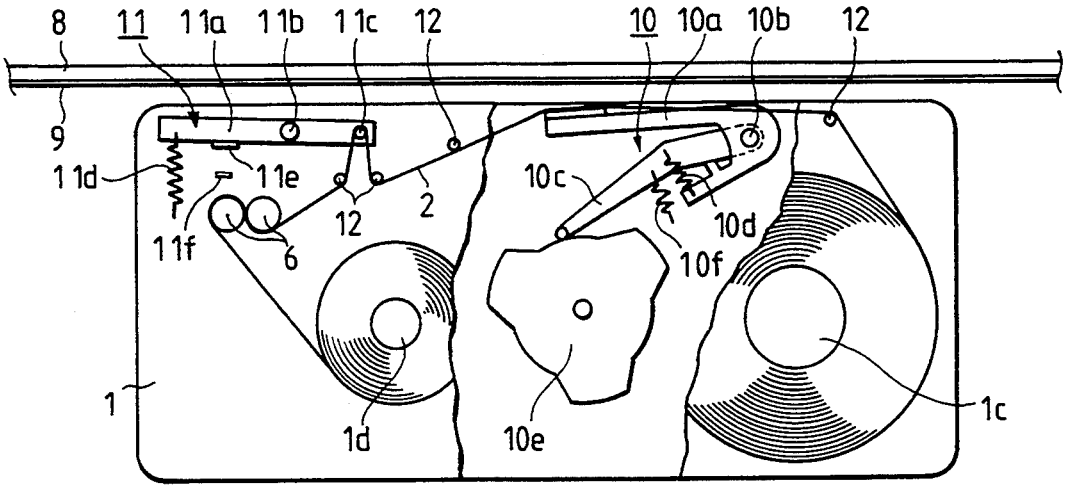
FIGS. 3A and 3B are each sectional view of the pertinent portion of the recording section.
Figure 3B:
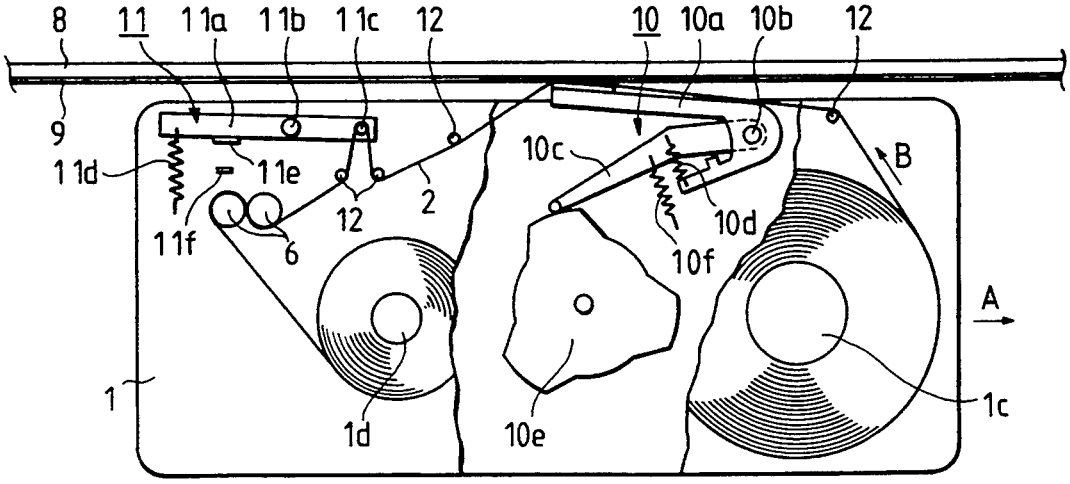

FIG. 1 is a perspective view for illustration of the heat transfer recording device according to the present invention, FIG. 2 is a sectional view for illustration of the heat transfer medium, FIGS. 3A and 3B are sectional views for illustration of the recording section during non-recording and during recording.

First, to describe above the schematic construction of the device as a whole, an ink ribbon 2 which becomes the transfer recording medium is housed within a cassette 1, and said casette 1 is mounted detachably on a carriage 3. The carriage 3 is constructed so that it can be moved in reciprocating manner along the carriage shaft 5 by a driving means 4. When the above carriage 3 moves in the direction of the arrowhead A, the ink ribbon 2 is delivered by a pair of conveying rollers 6 forming the conveying means for the ink ribbon 2, and at the same time the recording head 7 heats the ink ribbon 2, thereby transferring the ink onto an image-receiving medium (plain paper or plastic sheet, hereinafter called "recording paper") 9 supported at the back surface with a platen 8. Further, said recording paper 9 is adapted to be conveyed intermittently at every one line by a conveying means not shown.

Next, the constructions of the respective parts as mentioned above are to be described in detail. First, the cassette 1 consists of a lower case 1*a* and an upper cover 1*b*, with the ink ribbon 2 which becomes the heat transfer medium being wound up on a feeding reel 1*c* of the cassette 1 internally of said lower case 1*a*, led from said feeding reel 1*c* by the cutting (not shown) of the lower case 1*a* so as to be once exposed and then wound up on a take-up reel 1*d*.

The above ink ribbon 2 has heat transferable ink (heat meltable, heat softenable, heat sublimable, etc.) coated in layers, and preferably an ink containing a resin particularly an ionomer resin may be employed. Here, the ionomer resin refers to one having the main chain of hydrocarbon attached with side chain of carboxyl group partially or completely neutralized with metal ion or quaternary ammonium ion, and in this embodiment, among such ionomer resins, for example, a copolymer comprising an $\alpha$-olefin such as propylene, etc. and an $\alpha,\beta$-unsaturated carboxylic acid neutralized with metal ion is employed. In the above heat transfer ink component, the content of the ionomer resin may be preferably 5 to 70%.

The ink ribbon 2 used in this embodiment, as shown in FIG. 2, comprises a heat transferable ink layer formed by laminating successively an intermediate layer 2*b*, a first transfer layer 2*c*, a second transfer layer 2*d* on a support 2*a*. More specifically, it is described in Japanese Laid-open Patent Publication No. 63-309493 (published on Dec. 16, 1988), and a polyester film with a thickness of 6 $\mu$m and a width of 8 mm is used as the support 2*a*, and the intermediate layer 2*b*, the first transfer layer 2*c* and the second transfer layer 2*d* are formed by use of the following components, respectively.

| | |
|---|---|
| Intermediate layer (1.0 $\mu$m) | |
| Polyethylene oxide (Number-average molecular weight, 2000, oxidation 16, softening point 104° C.) | 80 parts |
| Surfactant | 15 parts |
| Amine | 5 parts |
| Deionized water | 405 parts |
| First transfer layer (2.2 $\mu$m) | |
| Ethylene-vinyl acetate resin dispersion (MI 6, ethylene content 80%) | 35 parts |
| Vinyl acetate-ethylene resin dispersion (Ethylene content 20%) | 30 parts |
| Ethylene-methacrylic acid copolymer Ionomer dispersion (Ethylene content 90%, ion contained:$Na^+$) | 20 parts |
| Carbon black dispersion (Carbon black/dispersing agent = 20/3) | 25 parts |
| Second transfer layer (1.2 $\mu$m) | |
| Ethylene vinyl acetate resin dispersion (MI 6, ethylene content 80%) | 40 parts |
| Ethyl methacrylate, styrene-modified ethylene-methacrylic acid copolymer Ionomer dispersion | 30 parts |

-continued

| | |
|---|---|
| (Ethylene content in ethylene-methacrylic acid copolymer 90%, ion contained:$Na^+$, styrene modification ratio 50%, ethyl methacrylate modification ratio 50%) | |
| Vinyl acetate-ethylene resin dispersion (Ethylene content 20%) | 30 parts |

To the carriage 3 is connected a belt 4c hanging over between pulleys 4a, 4b, and when the carriage motor 4d joined with said pulley 4a is driven, said carriage 3 is guided into the carriage shaft 5 to be moved in a reciprocal manner.

When said carriage 3 moves in the direction of the arrowhead A in FIG. 3, the pair of conveying rollers 6, driven by a motor, not shown, conveys the ink ribbon 2 in the direction of the arrowhead B, and also the recording head 7 slides under the state pressed against the platen 8 through the ink ribbon 2 and the recording paper 9, whereby the ink ribbon 2 is delivered successively from the feeding reel 1c.

Further, at a predetermined position of said carriage 3, a take-up shaft 3c joined through a friction clutch 3b with a take-up motor 3a provided within the carriage 3 is provided and is constituted so that it may rotate in the direction of the arrowhead C as synchronized with the movement of the carriage 3 only during recording (the carriage 3 moved in the direction of the arrowhead A). Said friction clutch 3b has a structure such that no rotatory force of the motor 3a is transmitted to the take-up shaft 3c when a torque of a certain value or higher is applied, which engages the take-up reel 1d of said cassette 1 with the take-up shaft 3c, and the ink ribbon 2 is taken up on the take-up reel 1d in only the amount delivered from the feeding reel 1c by driving of the motor 3a.

On the front surface of said carriage 3, a cutting 3d is formed at the position corresponding to the cutting of said lower case 1a, and a recording head 7 is provided at said cutting 3d portion rockably so as to go up and down in the direction of the arrowhead D.

Said recording head 7 has a glaze layer (not shown) provided on the head substrate 7a, and comprises a plurality of heat-generating elements 7b which generate heat by current passage corresponding to image signals arranged in an array on said glaze layer. Further, said array of heat-generating elements are arranged near the edge on the downstream side of the ink delivery direction of the head substrate 7a (the so called edge head). This is to permit the ink ribbon 2 heated with the above heat-generating elements 7b to be peeled off from the recording paper 9 within a short time of about several milliseconds, thereby improving ink detachment.

The distance $\Delta x$ from the edge of said heat-generating elements 7b to the edge of the head substrate 7a should be preferably set at about 250 $\mu$m or shorter, further preferably at 150 $\mu$m or shorter.

In the present embodiment, as the above recording head 7, one constituted to have a glaze layer thickness of 44 $\mu$m, an array of heat-generating elements with a dot density of 240 dot/inch and a length of 4.65 mm and a distance $\Delta x$ from the substrate edge to the heat-generating element array of 122 $\mu$m is used. The length of said recording head 7 pressed against the platen 8 is 6 mm.

Said recording head 7 is constituted so that it may be subjected to head down during recording, and also it may pressure contact said ink ribbon 2 with the recording paper 9 by a pressing means 10, simultaneously with pressing the platen 8 under a set pressure.

The platen 8 against which said recording head 7 is pressed is formed in shape of a flat plate, and in the present embodiment comprises a rigid rubber with a hardness of 73° formed into a flat plate shape with a width of 6 mm, which is mounted on a platen holder 8a.

Next, the above pressing means 10 is constituted as shown in FIG. 1 to FIG. 3, having a bent head arm 10a axially attached rotatably at the bent portion by a shaft 10b, one end 10a1 of said head arm 10a supporting said recording head 7, and a drawing spring 10d being mounted between the other end 10a2 of the head arm 10a and the pressing arm 10c.

Further, one end of said pressing arm 10c is axially attached rotatably by said shaft 10b, while the other end contacts the cam 10e so as to be urged to the outer peripheral thereof by the drawing spring 10f.

Accordingly, when the above cam 10e is rotated, the recording head 7 is subjected to head down and head up as shown in FIG. 3A and FIG. 3B. When the head comes down, the spring 10d is drawn, whereby the recording head 7 pressed the platen 8 under a predetermined pressure. The head pressure at this time should preferably set within the range of from 800 gf/cm to 3500 gf/cm, more preferably from 1100 gf/cm to 2500 gf/cm, further preferably from 1600 gf/cm to 2500 gf/cm.

The above ink ribbon 2 is constituted so that the tension on the downstream side in the conveying direction of the ink ribbon 2 from the recording head 7, namely on the take-up side (hereinafter called "front tension") can be changed by a tension means 11. The tension means 11 comprises a tension arm 11a axially attached rotatably by a shaft 11b, with its one end being provided with a moving roller 11c, and a drawing spring 11d being mounted on the other end. Further, said ink ribbon 2 is guided by the guiding rollers 12 provided at the lower case 1a and the moving roller 11c of said tension arm 11a, and reaches the take-up reel 1d via the pair of conveying rollers 6 which are driven by a motor (not shown).

Accordingly, said ink ribbon 2 is drawn toward the upper side in FIG. 3A and FIG. 3B by the drawing force of the spring 11d, whereby front tension is imparted.

Further, said tension arm 11a is mounted with a magnet 11e, and the lower case 1a in the vicinity of said magnet 11e is mounted with a hole element 11f. With such a constitution, the distance between said magnet 11e and hole element 11f, namely the inclination of the tension arm 11a is detected, and the position of said tension arm 11a is controlled constant by controlling the rotational speed of the pair of conveying rollers 6 during recording, thereby imparting a constant front tension to the ink ribbon 2 to prevent the ink ribbon 2 from delaying in peeling from the recording paper 9.

Next, the recording method when performing recording by use of the heat transfer recording device with the above construction is to be described.

By heading down the recording head 7, the platen 8 is pressed through the ink ribbon 2 and the recording paper 9 under a head pressure of 800 gf/cm to 3500 gf/cm, and the carriage 3 is permitted to run in the direction of the arrowhead A shown in FIG. 3B, while the ink ribbon 2 is delivered successively in the direction of the arrowhead B to perform recording. At this time, through the heat generated from the heat-generating elements *7b* corresponding to image signals, a heat transferable ink is melted to be adhered to the recording paper 9. The melted ink has a high viscosity because of consisting mainly of a resin, but due to the high head pressure as 800 gf/cm to 3500 gf/cm, the fibers of the recording paper 9 are subjected to elastic deformation, whereby said high viscosity melted ink can be well adapted along the fibers to be adhered at a broad contact area thereto.

Therefore, when the ink ribbon 2 is peeled off from the recording paper 9, the extending (extends like millet jelly) length of the melted ink when said melted ink and non-melted ink are broken becomes smaller. Also, substantially no transfer defect occurs at the image edge portion, whereby an image of high quality with sharp image edge can be obtained.

If said head pressure is made excessively high (higher than the setting pressure as mentioned above), the recording paper 9 will be damaged, and also the melted ink will penetrate deep into the fibers of the recording paper 9, whereby the image density is undesirably lowered.

In the following, the experimental results when heat transfer recording was performed by use of the heat transfer recording device as mentioned above under various head pressures.

On the three kinds of recording paper 9 shown below, the common test pattern was recorded in the 9 stages as shown below, and (1) sharpness of the edge portion in transferred image, (2) length of ink extension, (3) ink concentration, (4) damage of recording paper at that time were investigated, respectively.

| |
|---|
| Recording paper |
| (1) Bonded paper A (Bekk smoothness 2.5 sec.) |
| (2) Bonded paper B (Bekk smoothness 10 sec.) |
| (3) Embossed paper (Bekk smoothness 0 sec.) |
| Head pressure |
| (1) 333 gf/cm (200 gf) |
| (2) 500 gf/cm (300 gf) |
| (3) 667 gf/cm (400 gf) |
| (4) 833 gf/cm (500 gf) |
| (5) 1167 gf/cm (700 gf) |
| (6) 1667 gf/cm (1000 gf) |
| (7) 2500 gf/cm (1500 gf) |
| (8) 3333 gf/cm (2000 gf) |
| (9) 3833 gf/cm (2300 gf) |

(*Smoothness of embossed paper is inmeasurably rough)

(1) Sharpness of the edge portion in transferred image

Figure 4:
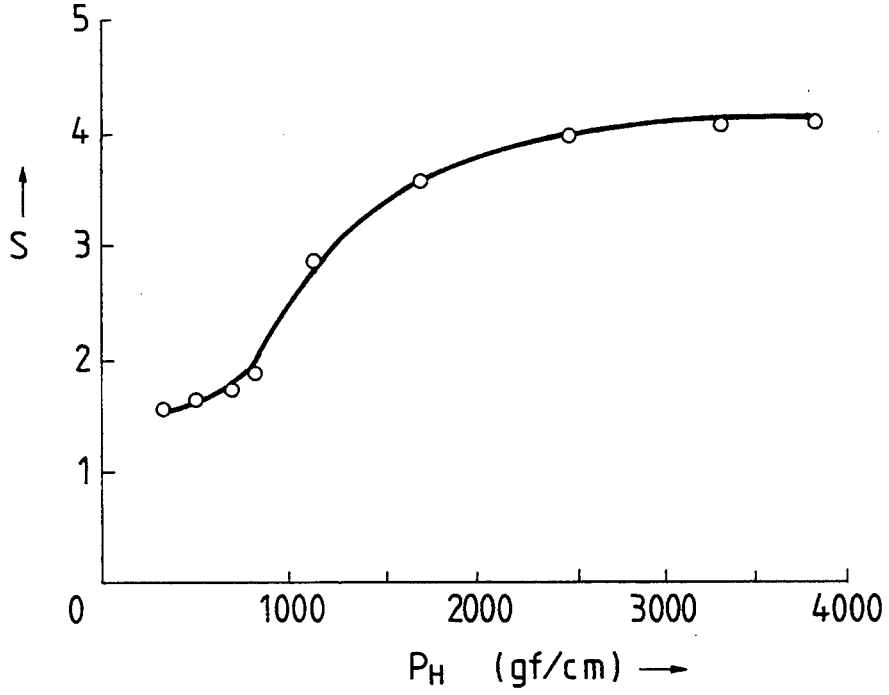
FIG. 4 is a graph showing sharpness of the edge portion in the transferred image versus head pressure.

The results of subjective evaluation of the sharpness S at the edge portion of the transferred image when recording was performed on the bonded paper A under the respective head pressures $P_H$ were as shown in FIG. 4. Evaluation in FIG. 4 was conducted with the evaluation when the head pressure $P_H$ is (5) 1167 gf/cm (700 gf) is made 3, and the evaluation when (7) 2500 gf/cm (1500 gf) is made 4.

As is also apparent from FIG. 4, the sharpness S at the edge portion of the image becomes abruptly good at around a head pressure $P_H$ of (4) 833 gf/cm (500 gf), improvement of image quality appearing at (5) 1167 gf/cm (700 gf) and further improvement of image quality being seen at (6) 1667 gf/cm (1000 gf). Even if the head pressure $P_H$ may be increased, image quality did not substantially change, until improvement of image quality reached the saturated region at around (7) 2500 gf/cm (1500 gf).

The above evaluation was common also to other recording papers.

(2) Length of ink extension

The sharpness S of the edge portion of said transferred image may be considered to be greatly affected by the extension of the melted ink. Accordingly, for the bonded paper A, the length L of ink extension relative to the above head pressure $P_H$ (length extended in millet jelly at the moment when the melted ink is broken from the non-melted ink) was observed by a high speed video, to give the results as shown in FIG. 5.

Figure 5:
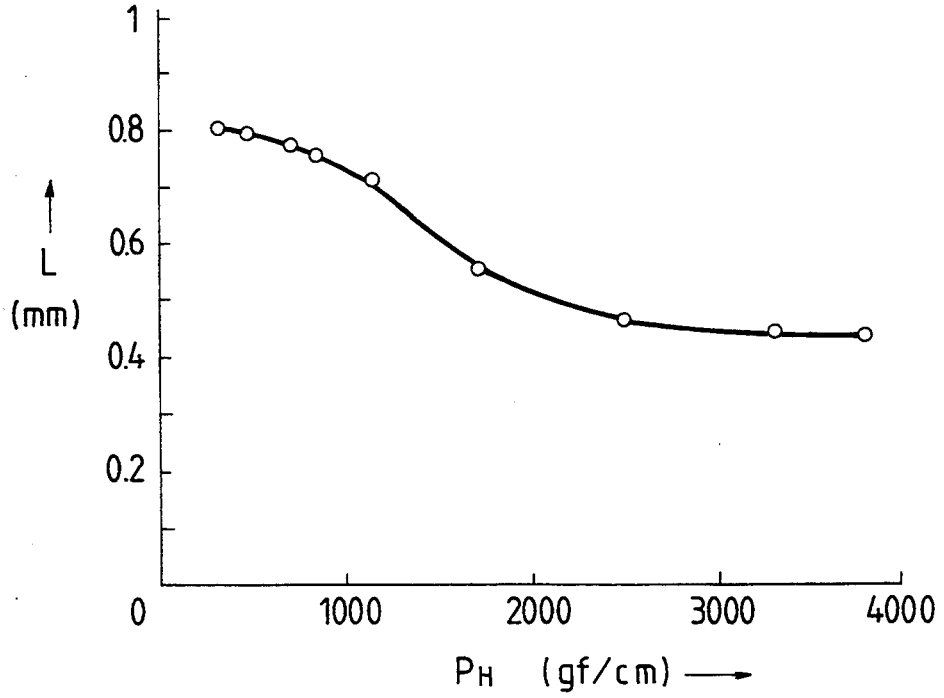
FIG. 5 is a graph showing extension of ink.

As is apparent from FIG. 4 and FIG. 5, it can be understood that the length of ink extension and the sharpness S of the image edge portion are correlated with each other and the sharpness S is lowered as the ink length is longer to make the image quality lower, while on the contrary, the sharpness S becomes higher as the ink extension is shorter to improve the image quality.

The length L of the above ink extension differed slightly depending on the smoothness of the recording paper, but the tendency relative to the head pressure $P_H$ was common to all the three kinds of papers.

(3) Ink density

Figure 6:
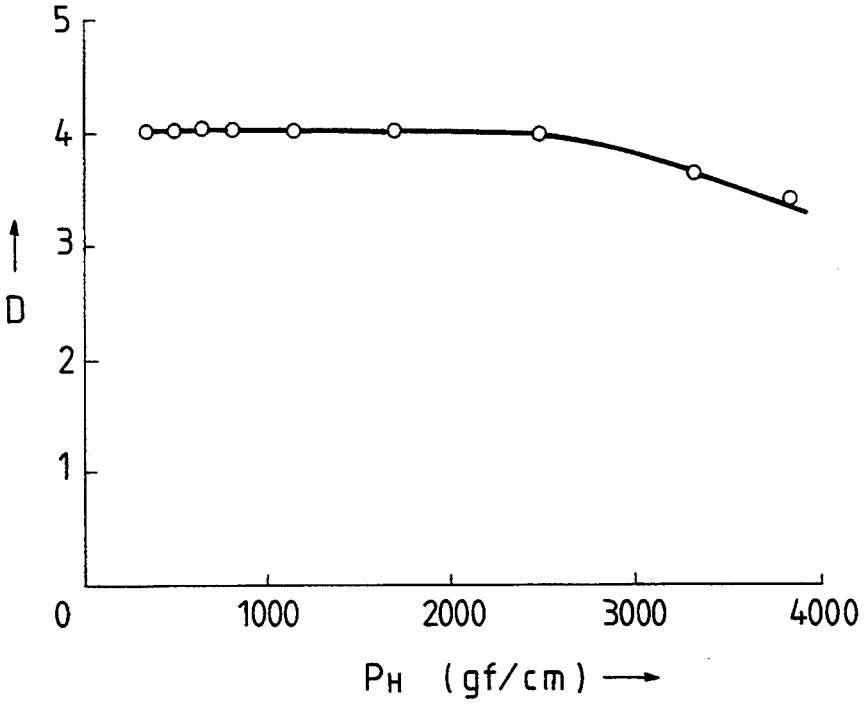
FIG. 6 is a graph showing ink concentration.

Under the respective head pressures $P_H$ as mentioned above, recording was performed on the bonded paper A, and subjective evaluations were done for the ink density D of the transferred image to give the results as shown in FIG. 6. Evaluation in FIG. 6 was conducted with the evaluation when the head pressure was the above (5) 1167 gf/cm (700 gf) being made 4.

As is apparent from FIG. 6, when the head pressure $P_H$ became the above (7) 2500 gf/cm (1500 gf) or higher, there occurred the phenomenon that the fibers of the paper appeared on the surface and the apparent ink density D was lowered.

(4) Damage of recording paper

Under the respective head pressured $P_H$ as mentioned above, recording was performed on the respective recording papers and it was examined whether the respective papers were damaged. As the result, no damage was seen on the respective papers up to the head pressure $P_H$ of (7) 2500 gf/cm (1500 gf).

Even when the head pressure $P_H$ was made (8) 3333 gf/cm (2000 gf), no damage was seen on the bonded papers A, B, but slight denaturation was observed on the embossed paper.

Further, when the head pressure $P_H$ was increased to (9) 3833 gf/cm (2300 gf), denaturation was seen on the respective recording papers.

(5) Overall evaluation

To summarize the evaluations (1) to (4) as described above, evaluation as shown in FIG. 7 can be done.

Figure 7:
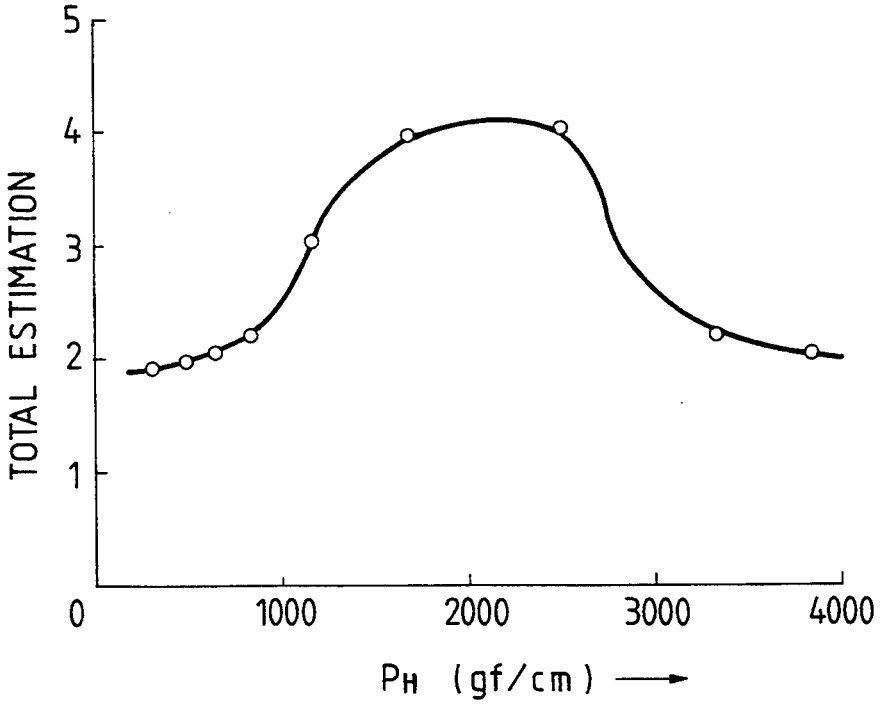
FIG. 7 is a graph showing overall evaluation of the transferred image versus head pressure.

As is apparent from FIG. 7, by setting the head pressure $P_H$ for the heat-generating element array at 800 gf/cm to 3500 gf/cm, it can be appreciated that good transferred image can be obtained even on a recording paper with low surface smoothness.

Further by setting the above head pressure $P_H$ at the range of 1100 gf/cm to 2500 gf/cm, it can be appreciated that considerably good transferred image including the point of image density can be obtained.

Further, by setting the above head pressure $P_H$ at 1600 gf/cm to 2500 gf/cm, it can be appreciated that the best transferred image can be obtained.

In the present embodiment, as described above, by heat transferring a heat transferable ink composed mainly of a resin by setting the head pressure $P_H$ at a high level within a specified range, good transferred image can be obtained even on a recording paper with low smoothness.

Other Embodiments

In carrying out recording by setting the head pressure $P_H$ as described above, it is preferable to use an ink composed mainly of a resin as the heat transferable ink to be used but the resin component of the ink is not limited to those used in the first embodiment, but otherwise acrylic resins, low molecular weight polyester resins, urethane resins, styrene-acrylic resins, polyamide resins, etc. can be also preferably used.

As the support, not only polyethylene film used in the first embodiment as described above, but also polyethylene terephthalate film and others can be preferably used.

In the present embodiment, as described above, by setting the head pressure by recording head when performing heat transfer recording at a high level within a specified range, good image can be transfer recorded not only on an image-receiving medium with high smoothness but also on an image-receiving medium with low smoothness.

Also, by use of a heat transfer medium containing a resin during the above recording, it becomes possible to improve more effectively the quality of the transferred image.

Further, by constructing the recording head by arrangement of the heat-generating elements near the edge portion of a head substrate and forming the platen in flat plate shape, the above-mentioned high head pressure can be more effectively imparted to give an image of higher quality.

Further, description is made about the second embodiment.

Second Embodiment

The embodiment described below concerns a recording device and a record correcting method which can well erase the image recorded in the above embodiment.

Figure 8:
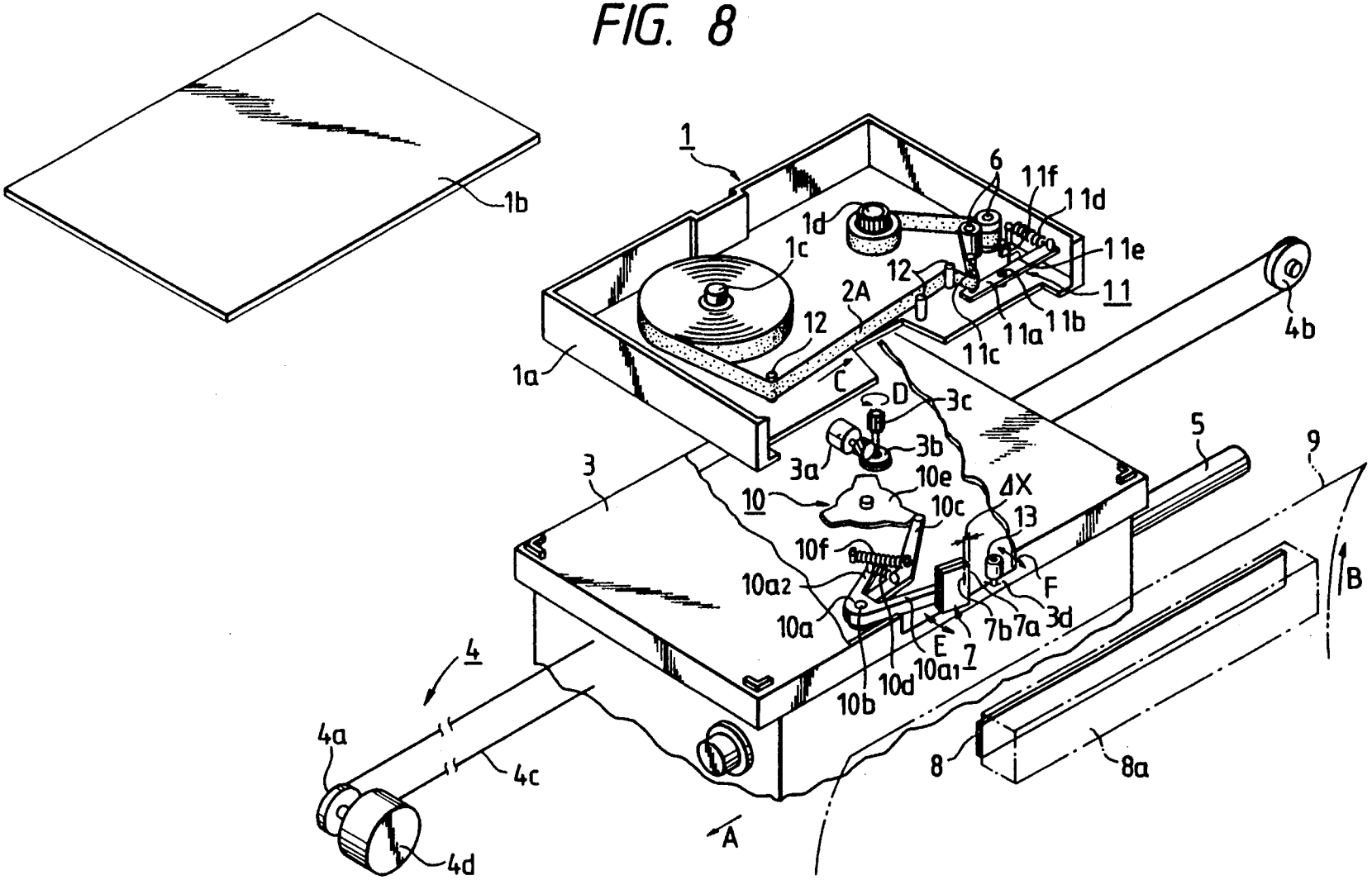
FIG. 8 is a perspective view for illustration of the heat transfer recording and record correcting device according to a second embodiment of the present invention.
Figure 9:
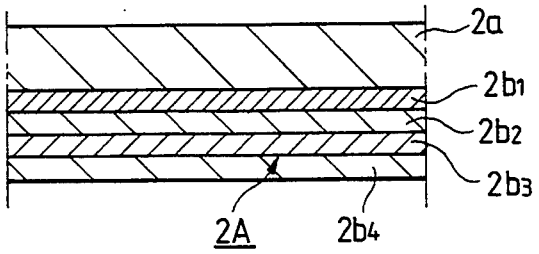
FIG. 9 is an illustration of the construction of the ribbon.
Figure 10A:
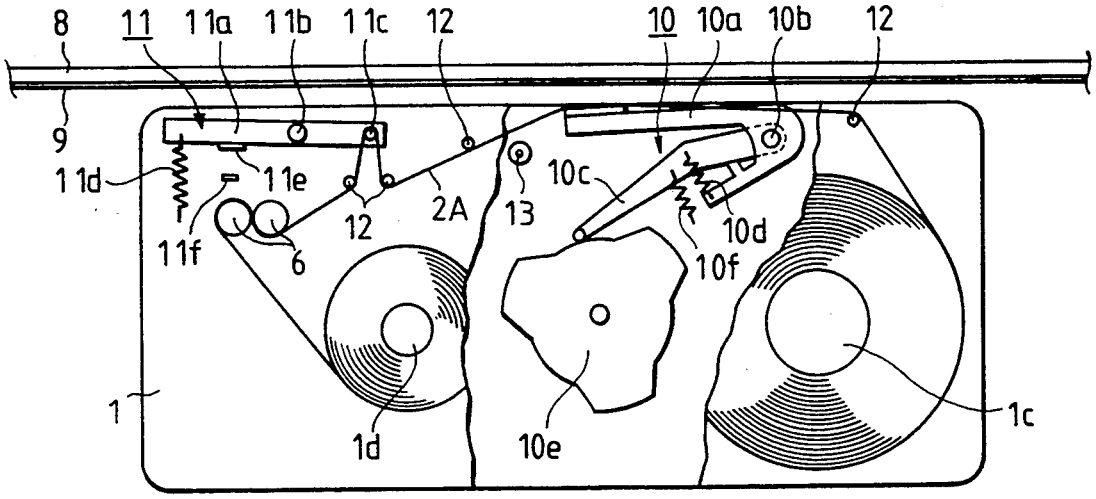
FIGS. 10A and 10B are illustrations of recording actuation.
Figure 10B:
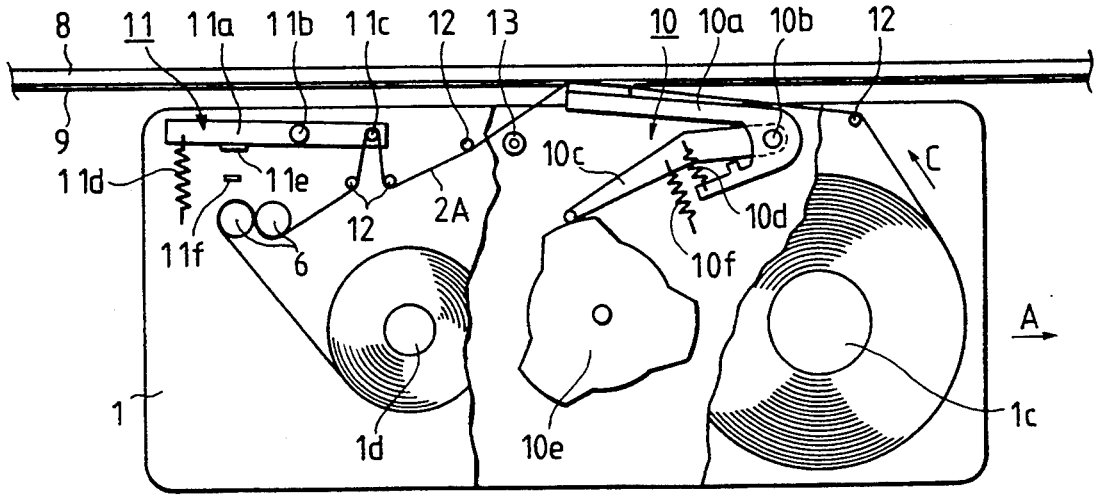

First, FIG. 8 is a perspective view for illustration of a device which employs the so called self-correctable ribbon functioning both as the heat transfer medium and the correcting medium, and can perform both of heat transfer recording and record correction with the same ribbon, and FIG. 9 is a sectional view for illustration of the self-correctable ribbon, and FIGS. 10A and 10B illustrate the recording actuation.

The schematic construction of the device as a whole is first described. As shown in the Figures, a self-correctable ribbon 2A which functions both as the transfer recording medium and the correcting medium is housed within a cassette 1, and the cassette 1 is mounted detachably on the carriage 3. The above carriage 3 is constructed so as to be movable in a reciprocating manner along the carriage shaft 5 by a driving means 4. When the above carriage 3 moves in the direction of the arrowhead A in FIG. 8, the ribbon 2A is delivered by the pair of conveying rollers 6 constituting the conveying means of the ribbon 2A, simultaneously with heating of the ribbon 2A with the recording head 7, to transfer the ink onto the image-receiving medium supported at the back surface with the platen 8 (pure paper or rough paper or plastic sheet, etc., hereinafter called "recording paper") 9, or peel off the ink transferred onto the recording paper 9 to effect correction. Further, the above recording paper 9 is constructed such that it is conveyed intermittently at every line in the direction of the arrowhead B in FIG. 8 by the conveying means not shown.

In the following, the constructions of the respective parts as mentioned above are to be described.

First, the cassette 1 consists of a lower case 1*a* and an upper cover 1*b*, with the self-correctable ribbon 2 being wound up on a feeding reel 1*c* of the cassette 1 internally of said lower case 1*a*, led from said feeding reel 1*c* at the opening of the lower case 1*a* so as to be once exposed and then wound up on a take-up reel 1*d* via the pair of conveying rollers 6.

The above self-correctable ribbon 2A has heat transferable ink (heat meltable, heat softenable, heat sublimable, etc.) and an adhesive layer coated in layers on a support, and preferably an ink containing a resin, particularly an ionomer resin may be employed. Here, the ionomer resin refers to one having the main chain of hydrocarbon attached with side chain of carboxyl group partially or completely neutralized with metal ion or quaternary ammonium ion, and in this embodiment, among such ionomer resins, for example, a copolymer comprising an $\alpha$-olefin such as propylene, etc. and an $\alpha,\beta$-unsaturated carboxylic acid neutralized with metal ion is employed. In the above heat transfer ink component, the content of the ionomer resin may be preferably 5 to 70%.

The self-correctable ribbon 2A in the present embodiment, as shown in FIG. 9, comprises a first ink layer 2*b*1, a second ink layer 2*b*2, a third ink layer 2*b*3 and a fourth ink layer 2*b*4 successively formed on a support was used, which is one as described in Japanese Patent Application No. 62-299046 (filed on Nov. 26, 1987) previously filed by the present Applicant.

More specifically, an emulsion (volatiles 40%) by use of a vinyl acetate-ethylene copolymer resin (ethylene content 20%) having a glass transition temperature of 0° C., a weight average molecular weight of 779000 is applied by coating on a support 2*a* comprising a polyethyleneterephthalate film of 6 μm by means of an applicator, dried in hot air dryer of 80° C. to obtain a first ink layer 2*b*1 with a thickness of 2.0 μm.

Next, on the above first ink layer 2*b*1 is applied by coating of an aqueous dispersion of the following recipe 1 diluted to 2-fold by means of an applicator, followed by drying in a hot air dryer of 60° C. for one minute to form a second ink layer 2*b*2 with a thickness of 1.5 μm. The second ink layer 2*b*2 has a melting point of 80° C. and a melt viscosity at 150° C. of 20 cps.

| | |
|---|---|
| Recipe 1 | |
| Carnauba wax | 26.0 parts |
| Surfactant (Polyoxyethylene lauryl ether) | 4.0 parts |
| Water | 70.0 parts |
| Recipe 2 | |
| Ethylene-vinyl acetate copolymer emulsion (Base resin MI 6, vinyl acetate content 28%, non-volatiles 25%) | 40 parts |
| Urethane resin emulsion (SP 180° C., non-volatiles 25%) | 5 parts |
| Vinyl acetate-ethylene copolymer emulsion (Vinyl acetate content 86%, non-volatiles 25%) | 15 parts |
| Aqueous carbon black dispersion | 40 parts |

-continued

| Recipe 3 | |
|---|---|
| Ethylene-vinyl acetate copolymer emulsion (Base resin MI 15, vinyl acetate content 28%, non-volatiles 25%) | 45 parts |
| Ethylene-methacrylic acid-styrene copolymer emulsion (Ethylene content 88%, non-volatiles 25%) | 25 parts |
| Vinyl acetate-ethylene copolymer emulsion (Base resin vinyl acetate content 86%, non-volatiles 25%) | 30 parts |

The formulations of the above recipes 2, 3 were uniformly mixed by a propeller type stirring machine to obtain coating liquids 2, 3. The coating liquid 2 was coated by use of an applicator on the above second ink layer 2b2, followed by hot air drying at 60° C. for one minute, to form a third ink layer 2b3 with a thickness of 1.5 μm. On this layer was coated the coating liquid 3 by use of an applicator, followed by hot air drying at 60° C. for one minute, to form a fourth ink layer 2b4 with a layer thickness of 1.7 μm.

The above first ink layer 2b1 is firmly adhered to the support 2a without separation either at the interface with the support 2a or internally thereof even during recording by heating. The second ink layer 2b2 is separated at the interface with the first ink layer 2b1 or internally of the second ink layer 2b2 during recording by heating to facilitate transfer of the third ink layer 2b3 or the following layers onto the recording transfer of 9. However, the non-heated portion of the second ink layer 2b2 is firmly adhered to the first ink layer 2b1 and the third ink layer 2b3, thereby inhibiting transfer of the third ink layer 2b3 or the following layers onto the recording paper 9. The third ink layer 2b3 has the coloration function, the film strength immediately after application of heat and the function of influencing the change in the film strength with lapse of time. The fourth ink layer 2b4 has adhesiveness to the recording paper 9 at the heat application portion, the film strength after application of heat and the function of influencing the change in film strength with lapse of time similarly as the third ink layer 2b3.

By peeling off the self-correctable ribbon 2A as constructed above from the recording paper 9 immediately after heating with the recording head 7, the heated ink is transferred onto the recording paper 9 to enable recording. Also, by peeling off the ribbon from the recording paper 9 with a delay after heating with the above recording head 7, the cohesive force of the ink can be restored, whereby it becomes possible to correct or erase the image by lift-off.

Next, to the carriage 3 is connected a belt 4c hanged between the pulleys 4a, 4b, and when the carriage motor 4d joined with said pulley 4a is driven, said carriage 3 is guided to the carriage shaft 5 to be moved in a reciprocating manner.

When said carriage 3 moves in the direction of the arrowhead A in FIG. 10B, the pair of conveying rollers 6 conveys said ribbon 2 in the direction of the arrowhead C by driving of the motor not shown, and at the same time the recording head 7 slides under the state pressing the platen 8 through the ribbon 2 and the recording paper 9, whereby the ribbon 2 is successively delivered from the feeding reel 1c.

Further, at a predetermined position of said carriage 3, a take-up shaft 3c joined through the take-up motor 3a and the friction clutch 3b is provided, engaged with the take-up reel 1d when the cassette 1 is mounted in the carriage 3, and adapted to rotate in the direction of the arrowhead D only during recording (the carriage 3 moves in the direction of the arrowhead A). Thus, the ribbon 2 delivered from said feeding reel 1c is taken up on the take-up reel 1d.

Also, at the front portion of said carriage 3, at the position corresponding to the opening when said cassette 1 is mounted, an opening 3d is formed, and the recording head 7 and the correction roller 13 are respectively mounted rockably so as to move up and down in the directions of the arrowheads E, F in FIG. 8.

Here, the construction of the above recording head is the same as described above for the first embodiment, and therefore the description give there is incorporated by way of reference.

Next, the above pressing means 10 is constituted as shown in FIG. 8, FIG. 10A and FIG. 10B, having a bent head arm 10a axially attached rotatably at the bent portion by a shaft 10b, one end 10a1 of said head arm 10a supporting said recording head 7, and a drawing spring 10d being mounted between the other end 10a2 of head arm 10a and the pressing arm 10c.

Further, one end of said pressing arm 10c is axially attached rotatably by said shaft 10b, while the other end contacts the cam 10e so as to be urged to the outer peripheral thereof by the drawing spring 10f.

Accordingly, when the above cam 10e is rotated, the recording head 7 is subjected to head down and head up as shown in FIG. 10A and FIG. 10B. When the head comes down, the spring 10d is drawn, whereby the recording head 7 pressed the platen 8 under a predetermined pressure. The head pressure at this time should preferably set within the range of from 800 gf/cm to 3500 gf/cm, more preferably from 1100 gf/cm to 2500 gf/cm, further preferably from 1600 gf/cm to 2500 gf/cm.

Next, the correcting roller 13 is provided at a position with a distance of 3 mm toward the downstream side of the delivery direction of the ribbon 2 from the substrate edge of said recording head 7, and is constructed so that said correcting roller 13 may be subjected to roller up and roller down in the direction of the arrowhead F in FIG. 8 by the same mechanism (not shown) as the pressing means 10 which permits said recording head 7 to go up and down.

Said correcting roller 13 is subjected to roller down during image correction to press the ribbon 2A against the recording paper 9, thereby delaying the time when the ribbon 2 heated with the recording head 7 is peeled off from the recording paper 9. Therefore, during image recording, said correcting roller 13 is under the state of roller up as shown in FIG. 10B, to be apart from the ribbon 2A.

The above ink ribbon 2A is constituted so that the tension on the downstream side in the conveying direction of the ribbon 2 from the correcting roller 13, namely on the take-up side (hereinafter called "front tension") can be changed by a tension means 11. The tension means 11 comprises a tension arm 11a axially attached rotatably by a shaft 11b, with its one end being provided with a moving roller 11c, and a drawing spring 11d being mounted on the other end. Further, said ribbon 2 is guided by the guiding rollers 12 provided at the lower case 1a and the moving roller 11c of said tension arm 11*a*, and reaches the take-up reel via the pair of conveying rollers 6.

Accordingly, said ink ribbon 2A is drawn toward the upper side in FIG. 10A and 10B by the drawing force of the spring 11*d*, whereby front tension is imparted.

Further, said tension arm 11*a* is mounted with a magnet 11*e*, and the lower case 1*a* in the vicinity of said magnet 11*e* is mounted with a hole element 11*f*. With such a constitution, the distance between said magnet 11*e* and hole element 11*f*, namely the inclination of the tension arm 11*a* is detected, and the position of said tension arm 11*a* is controlled constant by controlling the rotational speed of the pair of conveying rollers 6 during recording, thereby imparting a constant front tension to the ink ribbon to prevent the ink ribbon 2 from delaying in peeling from the recording paper 9. This means the tension along the ink ribbon can be varied as the pressure applied by the recording head changes.

Figure 12:
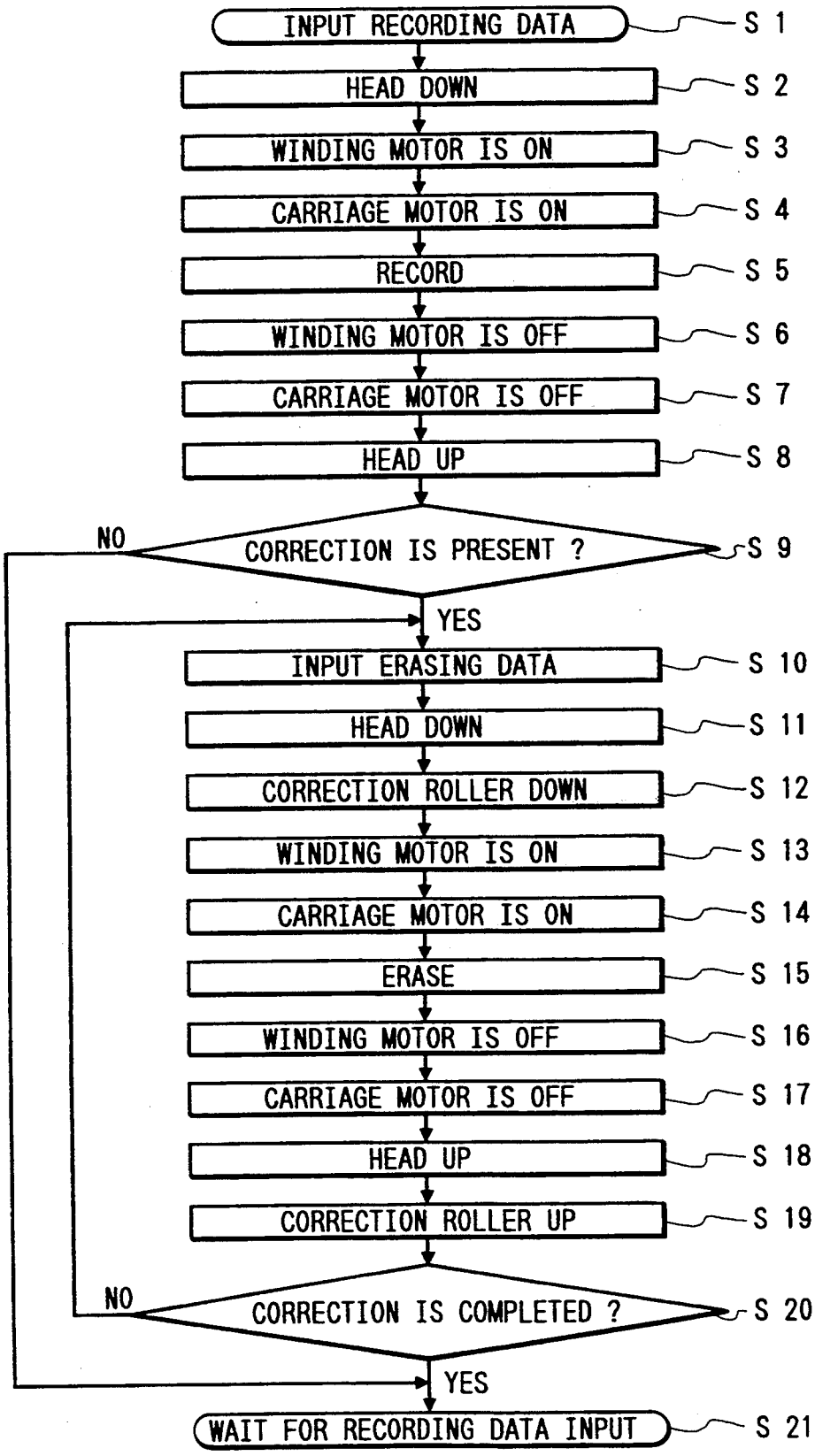
FIG. 12 is a flow chart of the device driving.

Next, the method for carrying out image recording and record correction by use of the device with the constitution as described above is to be described by referring to the flow chart in FIG. 12.

In the above flow chart, the step S1 to the step 8 are recording actuations and the step 9 to the step S20 are correction actuations.

First, the case of recording is to be described. First, when recording data are inputted, by heading down the recording head 7, the platen 8 is pressed through the ribbon 2 and the recording paper 9 under a head pressure of 800 gf/cm to 3500 gf/cm, and the carriage 3 is permitted to run in the direction of the arrowhead A shown in FIG. 10B by driving the take-up motor 3*a* and the carriage motor 4*d*, while the ribbon 2 is delivered successively in the direction of the arrowhead C. As synchronized with this, heat is generated from the recording head corresponding to the image signals and a heat transferable ink is melted by this heat to be adhered to the recording paper 9.

The above melted ink has a high viscosity because of consisting mainly of a resin, but due to the high head pressure as 800 gf/cm to 3500 gf/cm, the fibers of the recording paper 9 are subjected to elastic deformation, whereby said high viscosity melted ink can be well adapted along the fibers to be adhered at a broad contact area thereto. Therefore, when the ink ribbon 2 is peeled off from the recording paper 9, the extending (extends like millet jelly) length of the melted ink when said melted ink and non-melted ink are broken becomes smaller. For this reason, substantially no transfer defect occurs at the image edge portion, whereby an image of high quality with sharp image edge can be obtained.

Also, by performing recording with high head pressure as described above, recording is possible with a relatively lower heat energy. For this reason, the melted ink will be little penetrated into the recording paper 9, whereby correction also becomes easier.

If said head pressure is made excessively high (higher than the setting pressure as mentioned above), the recording paper 9 will be damaged, and also the melted ink will penetrate deep into the fibers of the recording paper 9, whereby the image density is undesirably lowered.

Figure 11:
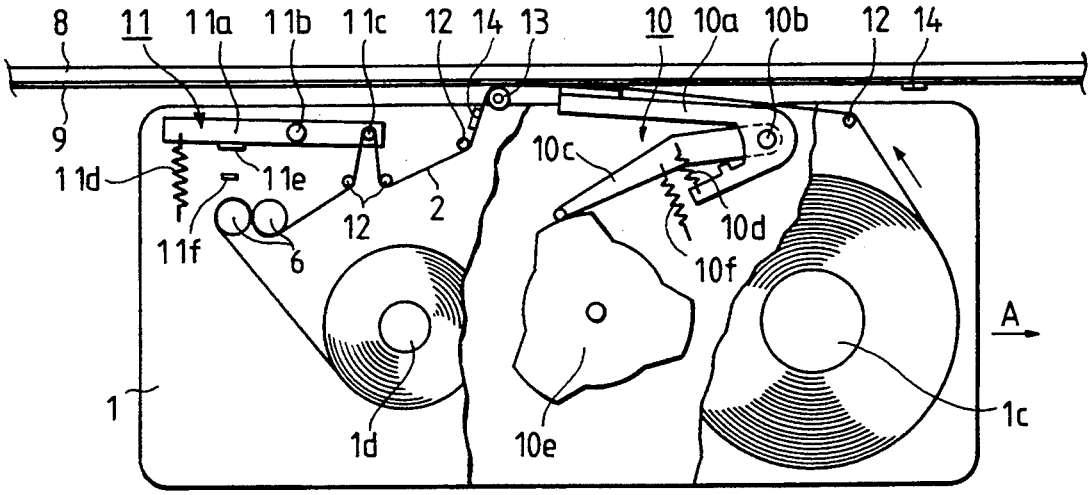
FIG. 11 is an illustration of correcting actuation.

In the following, description is made about the case of performing image correction. First, when erasing data are inputted, the recording head 7 is subjected to head down, while the correcting roller 13 to roller down, and the carriage 3 is permitted to run in the direction of the arrowhead A as shown in FIG. 11 by driving the take-up motor 3*a* and the carriage motor 4*d*. At this time, said head pressure is within the range of 800 gf/cm to 3500 gf/cm and presses the ribbon 2 and the recording paper 9 against the platen 8.

When the recording head 7 reaches the position of the image to be corrected 14, said recording head 7 generates selectively heat to heat the ribbon 2 overlapped on the image to be corrected 14, thereby adhering the image to be corrected 14 to the ribbon 2. The ribbon 2A is adhered to the recording paper 9 after heated at the recording head 7 until reaching the correcting roller 13, and in the course thereof, the ink layer of the ribbon 2A restores its cohesive force. Therefore, when the ribbon 2A is peeled off from the recording paper 9 at the position of the correcting roller 13, the above image 14 to be corrected will be peeled off as adhered on the ribbon 2.

Since said image to be corrected 14 is pressed onto the recording paper 9 under a high pressure when recorded, it comes into the concavity of paper fibers, although not penetrated into the recording paper 9. Accordingly, during correction, by pressing the ribbon 2 against the recording paper 9 under substantially the same high pressure as during recording, the paper fibers of the recording paper 9 are subjected to the same elastic deformation as during recording, whereby the transferred ink coming into the concavity of fibers is adhered onto the ribbon 2, thereby peeling off the ink from the recording paper 9.

If the head pressure during correction is smaller to great extent than during recording, the elastic deformation of the recording paper fibers by said head pressure differs from that during recording, whereby the transferred ink coming into the fiber concavity cannot be completely peeled off. On the contrary, if the head pressure is greater to great extent than during recording, a part of said transferred ink will be pushed deep into the concavity of the paper fibers by the head pressure. Accordingly, in correcting the image, pressing of the ribbon 2 against the recording paper 9 under substantially the same pressure as during recording can give desirable results.

Experimental Results

In the following, the experimental results when heat transfer recording was performed with various head pressures and recorded image correction was effected are shown.

First, the results of recording are the same as described above for the first embodiment, and the description there is incorporated by way of reference.

In the following, the results when the transferred image recorded as described above was corrected or erased are shown.

By use of the device as described above, on the two kinds of the recording papers shown below, recording was performed with the common test pattern at the four stages of the head pressures shown below so that good transferred image could be obtained within the range of high head pressure as mentioned above, and erasability of the respective transferred images was verified by varying the head pressure.

---

Recording paper (1) Typewriting paper (Bekk smoothness 40 sec)

-continued

| |
|---|
| (2) Bonded paper (Bekk smoothness 2.5 sec) |
| Head pressure |
| (1) 1167 gf/cm (700 gf) |
| (2) 1667 gf/cm (1000 gf) |
| (3) 2500 gf/cm (1500 gf) |
| (4) 3333 gf/cm (2000 gf) |

The results were as shown in FIG. 13A to 13D.

Figure 13A:
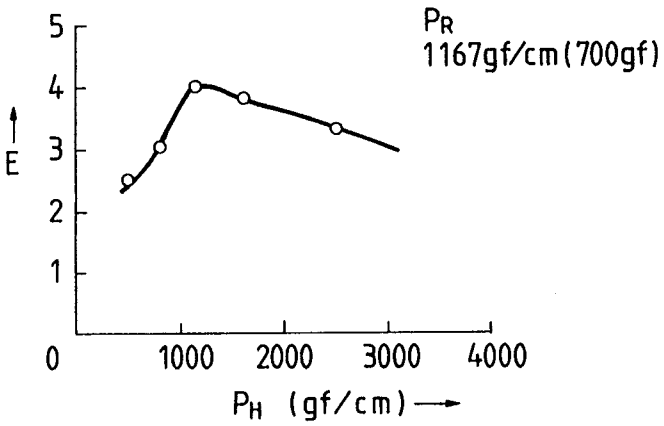
FIGS. 13A through 13D are graphs showing erasability versus head pressure in image correction.

(1) The graph in FIG. 13A

FIG. 13A shows subjective evaluation of the erasability of the recording on typewriting paper under a head pressure $P_R$ of 1167 gf/cm (700 gf) by varying the head pressure $P_H$ during correction as plotted.

The above evaluation was performed with the evaluation when the head pressure $P_H$ during correction is 833 gf/cm (500 gf) being made 3, and that when it is 1167 gf/cm (700 gf) being made 4.

Figure 13B:
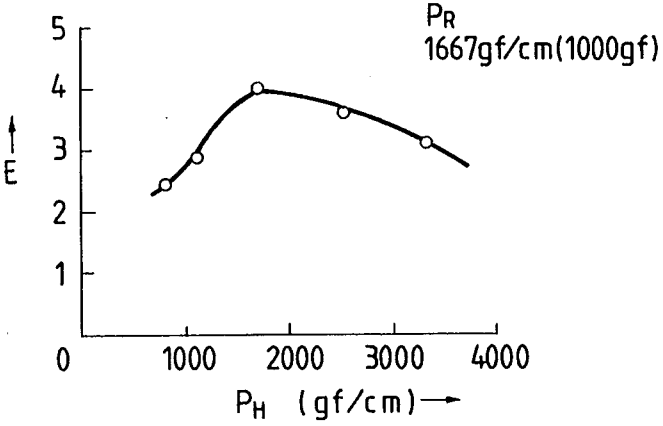

(2) The graph in FIG. 13B

FIG. 13B shows similarly subjective evaluation of the erasability E of the recording on typewriting paper under a head pressure $P_R$ of 1667 gf/cm (1000 gf) by varying the head pressure $P_H$ during correction as plotted.

Evaluation of erasability was conducted with evaluation of the recordability and erasability at the head pressure $P_H$ of 1167 gf/cm (700 gf) as the standard.

Figure 13C:
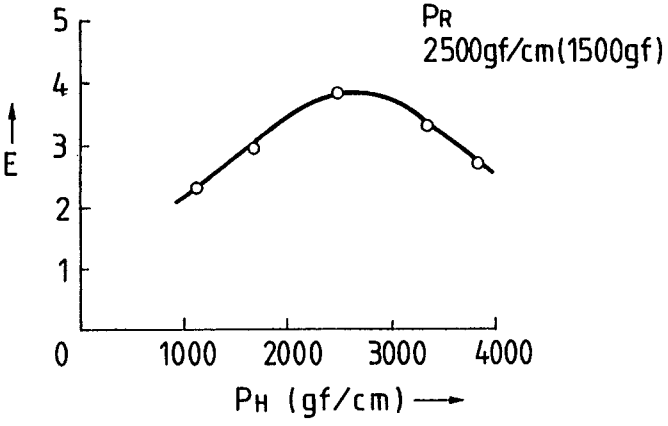

(3) The graph in FIG. 13C

FIG. 13C shows subjective evaluation of the erasability E of the recording on typewriting paper under a head pressure $P_R$ of 2500 gf/cm (1500 gf) by varying the head pressure $P_H$ during correction as plotted.

The evaluation standard is the same as in the case of the above FIG. 3B.

Figure 13D:
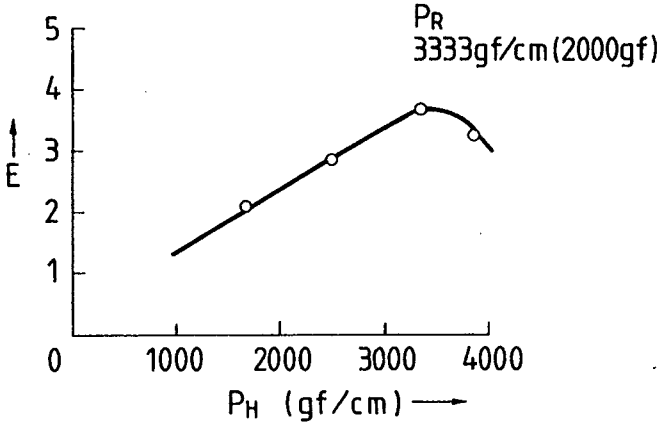

(4) The graph in FIG. 13D

FIG. 13D shows subjective evaluation of the erasability E of the recording on typewriting paper under a head pressure $P_R$ of 3333 gf/cm (2000 gf) by varying the head pressure $P_H$ during correction as plotted.

Also in this case, the evaluation standard is the same as in the case of the above FIG. 3B.

As is apparent from the above FIGS. 13A to 13D, the erasability E was found to be the best when the head pressure $P_H$ was equal to the head pressure during recording, and generally good erasability could be obtained in the range of about 90% to 120% of the head pressure during recording. Also, the above tendency was also remarkably observed in the bonded paper.

In the present embodiment, as described above, by effecting transfer recording of a heat transferable ink composed mainly of a resin by setting the head pressure at a high level within a specified range, good transferred image can be obtained even on a recording medium with low smoothness, and yet correction of the transferred image can be done well by making the head pressure during correction substantially equal to the above head pressure during recording.

Other Embodiments

In the second embodiment as described above, there is shown an example in which recording and correction are done with the same ribbon by use of the self-correctable ribbon 2 which function both as the heat transfer medium and the correction medium, but a ribbon for exclusive use for recording and a ribbon for exclusive use for correction may be also separately used.

As the ribbon for exclusive use for correction, for example, the ribbon disclosed in Japanese Laid-open Patent Publication No. 63-309493 (published on Dec. 16, 1988) previously filed by the present Applicants may be also used. More specifically, it has a first layer and a second layer comprising the following components formed on a support comprising a polyethyleneterephthalate film with a thickness of 6 μm.

| | |
|---|---|
| First layer (Thickness 3.5 μm) | |
| Vinyl acetate-ethylene resin emulsion (Vinyl acetate content 80%, glass transition temperature 0° C.) | 100 parts |
| Second layer (Thickness 6.5 μm) | |
| Ethylene-vinyl acetate resin emulsion | 97 parts |
| Polyvinyl alcohol (Polymerization degree 1700, saponification degree 88 mol %) | 3 parts |

It is preferable to use an ink composed mainly of a resin for the heat transferable ink to be used in recording, and the resin component of the ink is not limited to that of the embodiment as described above, but, for example, acrylic resins, low molecular weight polyester resins, urethane resins, styrene-acrylic resins, polyamide resins, etc. can be preferably used.

The present embodiment can remove the ink incorporated into fine concavities of an image-receiving medium by correcting the image recorded with a head pressure set at a high level within a specific range with substantially the same head pressure as during recording, thereby enabling good correction.

Further, the third embodiment is to be described.

Third Embodiment

The embodiment as described below is a heat transfer recording device which performs transfer recording onto an image-receiving medium by heating selectively a heat transfer medium by a recording head, provided with a recording head comprising heat-generating elements which generate heat corresponding to image signals arranged in an array on the edge side surface of a substrate, a platen against which said recording head is pressed through said heat transfer medium and image-receiving medium, pressing means for pressing said recording head against said platen under a head pressure of 300 gf/cm to 1500 gf/cm, heat transfer medium having an ink composed mainly of a resin and having a wider width than the pressing width of said recording head for pressing, and a means for peeling the heat transfer medium heated with said recording head from the image-receiving medium before conveying said transfer medium 300 μm after heating.

According to the above embodiment, since the effective contact area head pressure between the heat transfer medium and the image-receiving medium during recording can be made higher, the image-receiving medium is elastically deformed, whereby the ink composed mainly of a resin can be adapted well to the image-receiving medium to be contacted at broad area therewith. Therefore, extension of the ink when peeling the heat transfer medium from the image-receiving medium becomes smaller, and also substantially no image defect, etc. will occur.

Also, by providing the heat-generating elements of the recording head at the edge side surface of the head substrate, the heat transfer medium after heating in the heat-generating elements can be rapidly peeled off from the image-receiving medium.

Further, since the width of the heat transfer medium is wider than the width of the recording head which presses the platen, there is no fear of the recording head squeezing the image-receiving medium.

Also, in the present embodiment, since the pressing pressure is not required to be made larger than is necessary, the construction of the recording device is not required to increase strengths of the respective parts so as to stand higher pressing pressure or make greater the output of the motors to be used for the respective parts of recording section, whereby enlargement of the device and the cost increase can be prevented.

Figure 14:
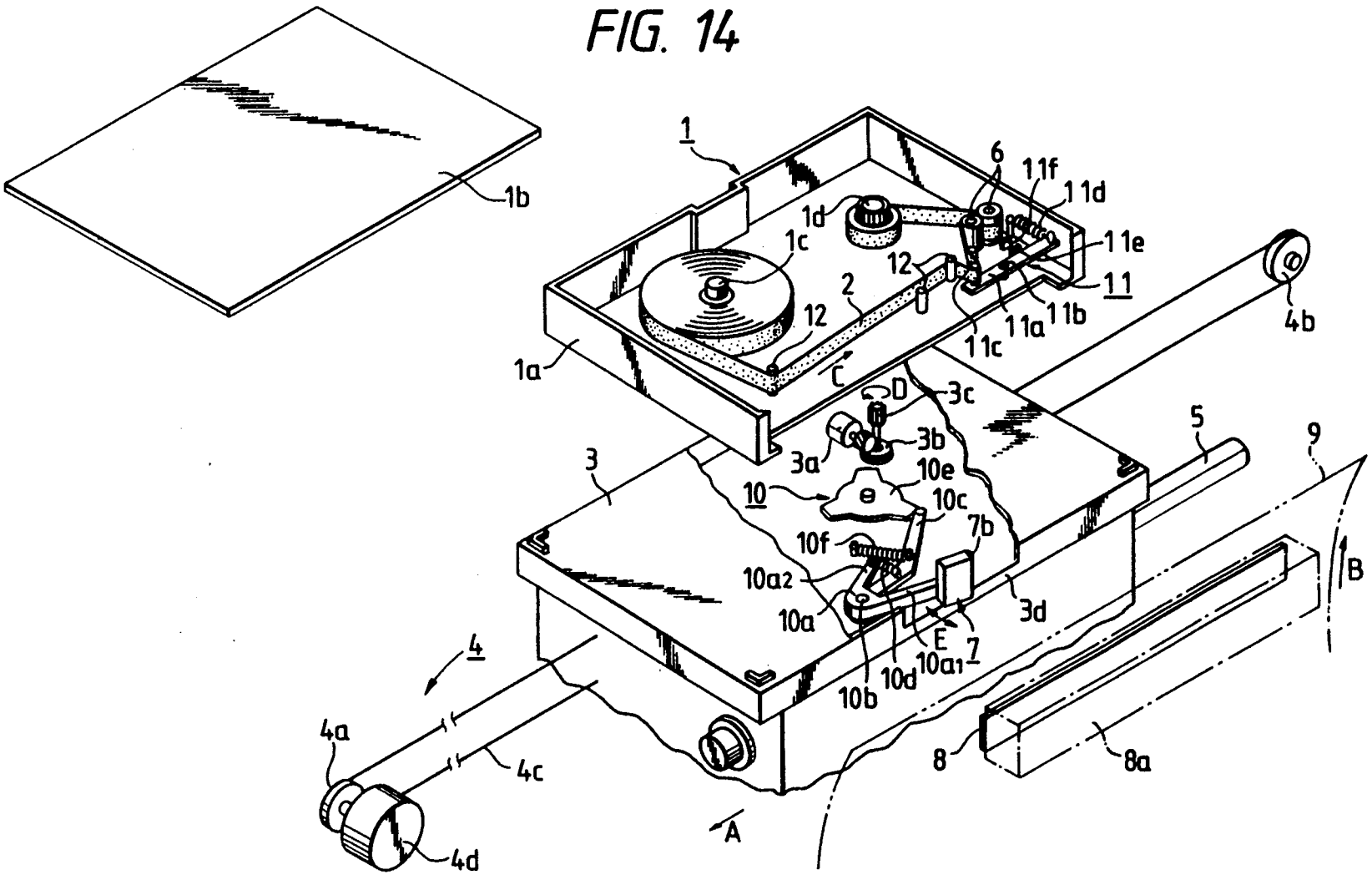
FIG. 14 is a perspective view of the heat transfer recording device according to a third embodiment of the present invention.
Figure 15A:
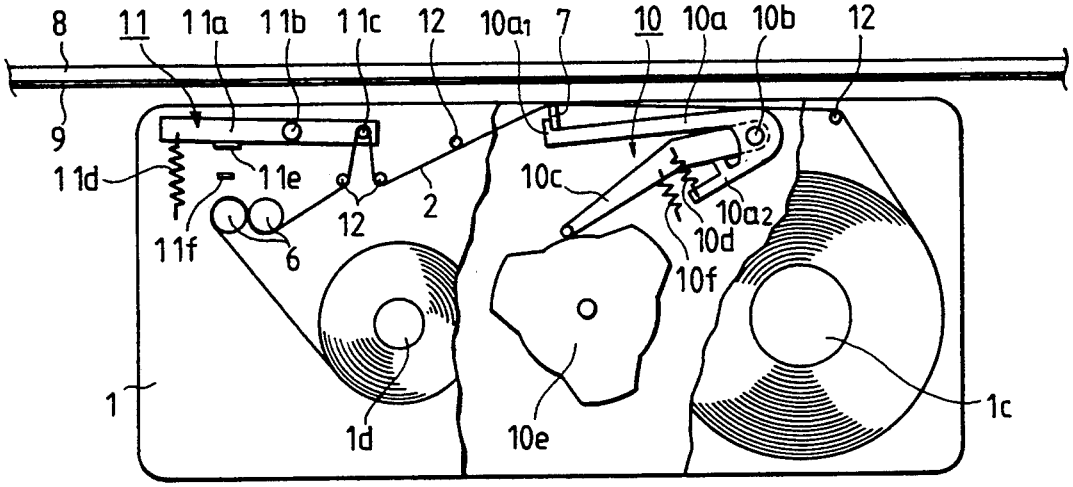
FIGS. 15A and 15B are illustrations of recording actuation.
Figure 15B:
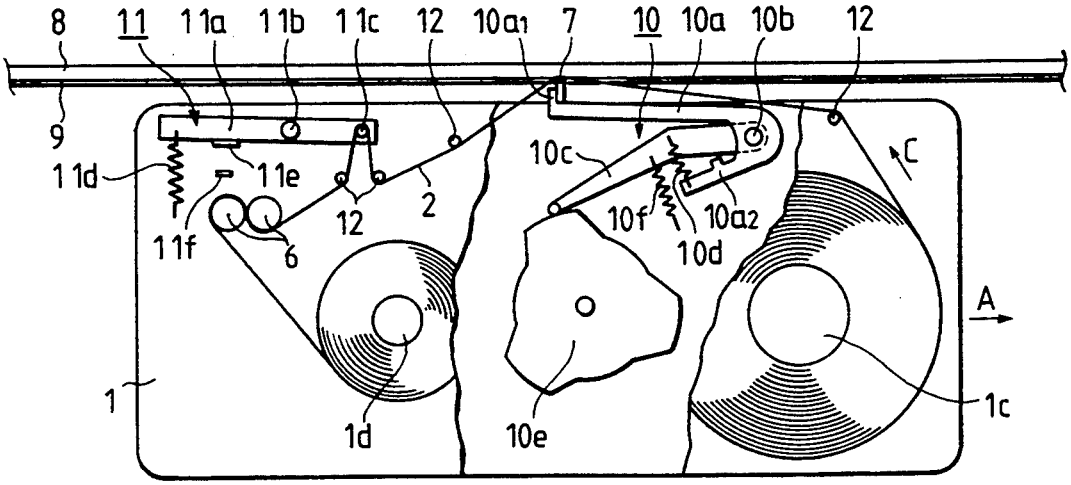

FIG. 14 is a perspective view for illustration of the heat transfer recording device according to the third embodiment, FIGS. 15A and 15B are sectional views for illustration of the recording section during non-recording and during recording.

Description is made about the same members as in the above first embodiment by affixing the same numerals. The material of the ink ribbon used in the present embodiment is the same as that used for the ink ribbon shown in the above first embodiment, and the same description is incorporated by way of reference.

Now, in the present embodiment, at a predetermined position of said carriage 3, a take-up shaft 3*c* joined through a take-up motor 3*a* and a friction clutch 3*b* is provided and is constituted so that it may rotate in the direction of the arrowhead D only during recording (the carriage moved in the direction of the arrowhead A). With such a construction, the ribbon 2 delivered from said feeding reel 1*c* is taken up on the take-up reel 1*d*.

In FIG. 14, 12 is the guide shaft of the ink ribbon 2.

On the front surface of said carriage 3, a cutting 3*d* is formed at the position corresponding to the cutting of said lower case 1*a*, and a recording head 7 is provided at said cutting 3*d* portion rockably so as to go up and down in the direction of the arrowhead E.

Figure 16:
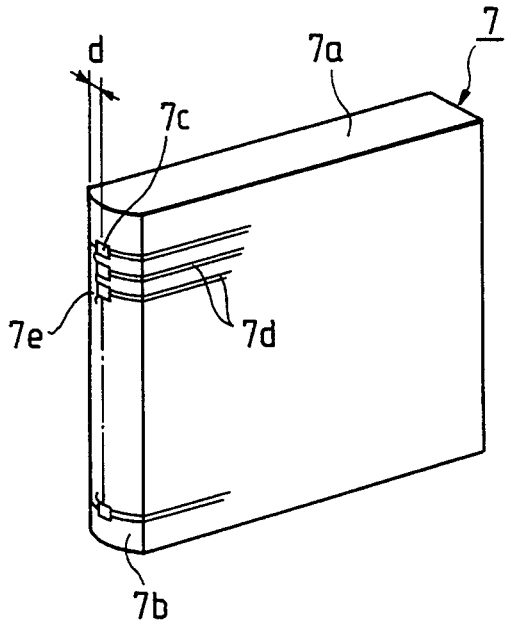
FIG. 16 is an illustration of the construction of the recording head.

Said recording head 7 has a glaze layer 7 provided on the head substrate 7*a* as shown in FIG. 16, and comprises a plurality of heat-generating elements which generate heat by current passage corresponding to image signals arranged in an array on said glaze layer, and the heat-generating elements 7*c* generate heat selectively by applying a voltage between the individual electrode 7*d* and the common electrode 7*e*. By providing the array of the heat-generating elements on the side edge of the substrate as described above, the ink ribbon 2 heated with said heat-generating elements 7*c* can be peeled off from the recording paper 9 within a short time of about several milliseconds after heating.

In the present embodiment, as the above recording head 7, one constituted to have a glaze layer thickness of 44 μm, an array of heat-generating elements with a dot density of 240 dot/inch and a length of 4.65 mm and a distance d from the array of the heat-generating elements 7*c* to the substrate side edge of 200 μm is used. By use of such recording head, the ink ribbon will be peeled off before conveyed 200 μm after heated with the heat-generating elements 7*c*, thus enabling peel-off of the ink ribbon 2 from the recording paper 9 within a short time. If the distance until peeling after heating occurs is set at about 300 μm or less, the ink ribbon 2 heated with the heat-generating elements 7*c* will be peeled off from the recording paper within a short time of about several milliseconds after heating.

Figure 17:
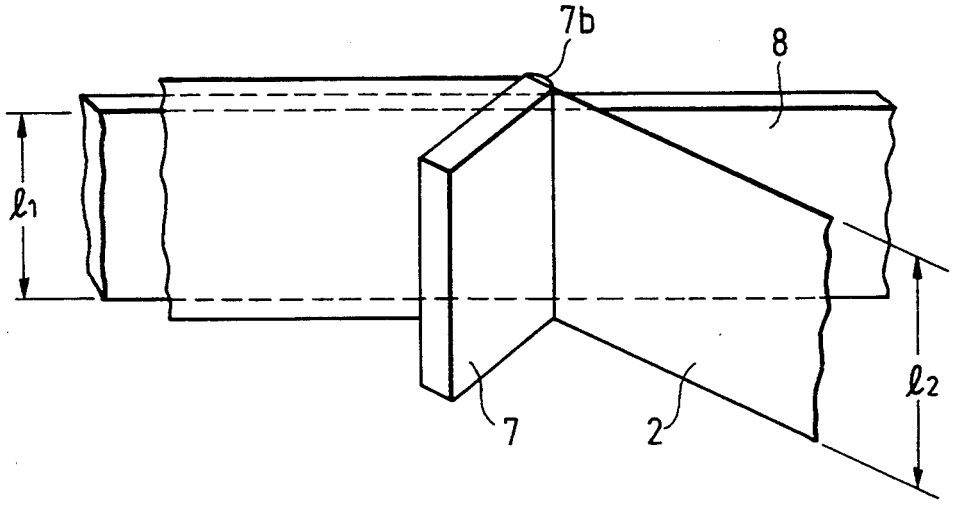
FIG. 17 is an illustration showing the state of the pressing width of the recording head and the ink ribbon width.

Also, as shown in FIG. 17, the length 11 of the above recording head pressing the platen 8 is constructed as 6 mm which is shorter than the width l2 (l2=8 mm) of the ink ribbon 2.

Said recording head 7 is constituted so that it may be subjected to pressure contact to effect pressure contact of said ink ribbon 2 with the recording paper 9 by a pressing means 10, simultaneously with pressing the platen 9 under a set pressure.

The platen 8 against which said recording head 7 is pressed is formed in shape of a flat plate, and in the present embodiment comprises a rigid rubber with a hardness of 73° formed into a flat plate shape with a width of 6 mm, which is mounted on a platen holder 8*a*.

Next, the above pressing means 10 is constituted as shown in FIG. 14 and FIGS. 15A and 15B, having a bent head arm 10*a* axially attached rotatably at the bent portion by a shaft 10*b*, one end 10*a*1 of said head arm supporting said recording head 7, and a drawing spring 10*d* being mounted between the other end 10*a*2 and the pressing arm 10*c*.

Further, one end of said pressing arm 10*c* is axially attached rotatably by said shaft 10*b*, while the other end contacts the cam 10*e* so as to be urged to the outer peripheral thereof by the drawing spring 10*f*.

Accordingly, when the above cam 10*e* is rotated, the recording head 7 is subjected to head down and head up as shown in FIGS. 15A and 15B. When the head comes down, the spring 10*d* is drawn, whereby the recording head 7 pressed the platen 8 under a predetermined pressure. The head pressure at this time should preferably set within the range of from 300 gf/cm to 1500 gf/cm, more preferably from 450 gf/cm to 1100 gf/cm, further preferably from 600 gf/cm to 1100 gf/cm.

Next, the recording method when performing recording by use of the heat transfer recording device with the above construction is to be described.

By heading down the recording head 7, the platen 8 is pressed through the ink ribbon 2 and the recording paper 9 under a head pressure of 300 gf/cm to 1500 gf/cm, and the carriage 3 is permitted to run in the direction of the arrowhead A shown in FIG. 15B, while the ink ribbon 2 is delivered successively in the direction of the arrowhead C, by conveying rollers 6 which are driven by a motor (not shown), to perform recording. At this time, through the heat generated from the heat-generating elements 7*c* corresponding to image signals, a heat transferable ink is melted to be adhered to the recording paper 9. The melted ink has a high viscosity because of consisting mainly of a resin, but due to the high head pressure as 800 gf/cm to 3500 gf/cm, the fibers of the recording paper 9 are subjected to elastic deformation, whereby said high viscosity melted ink can be well adapted along the fibers to be adhered at a broad contact area thereto. Further, since the heat-generating element array is provided at the substrate side edge surface of the recording head, the ink ribbon 2 heated with said heat-generating element will be peeled off from the recording paper immediately thereafter.

Therefore, when the ink ribbon 2 is peeled off from the recording paper 9, the extending (extends like thick and sticky malt syrup) length of the melted ink when said melted ink and non-melted ink are broken becomes smaller. Also, substantially no transfer defect occurs at the image edge portion, whereby an image of high quality with sharp image edge can be obtained.

Further, since the ink ribbon 2 is formed with wider width than the length in the heat-generating element array direction of the above recording head 7 pressing the platen 8, the recording head 7 will not directly squeeze the recording paper 9, whereby the recording paper is not damaged at all.

If said head pressure is made excessively high (higher than the setting pressure as mentioned above), the recording paper 9 will be damaged even with the ink ribbon 2 being interposed, and also the melted ink will penetrate deep into the fibers of the recording paper 9, whereby the image density is undesirably lowered.

Experimental Results

In the following, the experimental results when heat transfer recording was performed by use of the heat transfer recording device of the third embodiment as mentioned above under various head pressures, and correction of the recorded images was conducted.

On the three kinds of recording paper 9 shown below, the common test pattern was recorded in the 10 stages as shown below, and (1) sharpness of the edge portion transferred image, (2) length of ink extension, (3) ink concentration, (4) damage of recording paper at that time were investigated, respectively.

| |
|---|
| Recording paper |
| (1) Bonded paper A (Bekk smoothness 2.5 sec.) |
| (2) Bonded paper B (Bekk smoothness 10 sec.) |
| (3) Embossed paper (Bekk smoothness 0 sec.) |
| Head pressure |
| (1) 100 gf/cm |
| (2) 200 gf/cm |
| (3) 300 gf/cm |
| (4) 400 gf/cm |
| (5) 500 gf/cm |
| (6) 700 gf/cm |
| (7) 1000 gf/cm |
| (8) 1200 gf/cm |
| (9) 1500 gf/cm |
| (10) 1700 gf/cm |

(*Smoothness of embossed paper is inmeasurably rough)

(1) Sharpness of the edge portion in transferred image

Figure 18:
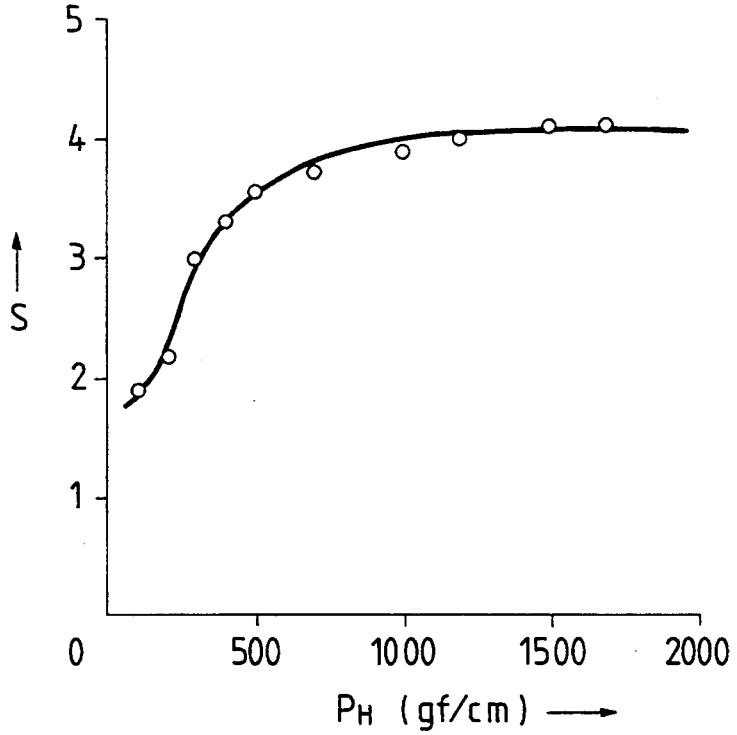
FIG. 18 is a graph showing evaluation of sharpness of the edge portion of the transferred image versus head pressure.

The results of subjective evaluation of the sharpness S at the edge portion of the transferred image when recording was performed on the bonded paper A under the respective head pressures $P_H$ were as shown in FIG. 18.

Evaluation in FIG. 18 was conducted with the evaluation when the head pressure $P_H$ is 300 gf/cm is made 3, and the evaluation when 1200 gf/cm is made 4.

As is also apparent from FIG. 18, the sharpness S at the edge portion of the image becomes abruptly good at around a head pressure $P_H$ of 300 gf/cm, improvement of image quality appearing remarkably at around 400 gf/cm, and further improvement of image quality being seen at around 600 gf/cm. Even if the head pressure $P_H$ may be increased, image quality did not substantially change, until improvement of image quality reached the saturated region at around 1000 gf/cm.

The above evaluation was common also to other recording papers.

(2) Length of ink extension

The sharpness S of the edge portion of said transferred image may be considered to be greatly affected by the extension of the melted ink. Accordingly, for the bonded paper A, the length L of ink extension relative to the above head pressure $P_H$ (length extended in millet jelly at the moment when the melted ink is broken from the non-melted ink) was observed by a high speed video, to give the results as shown in FIG. 19.

Figure 19:
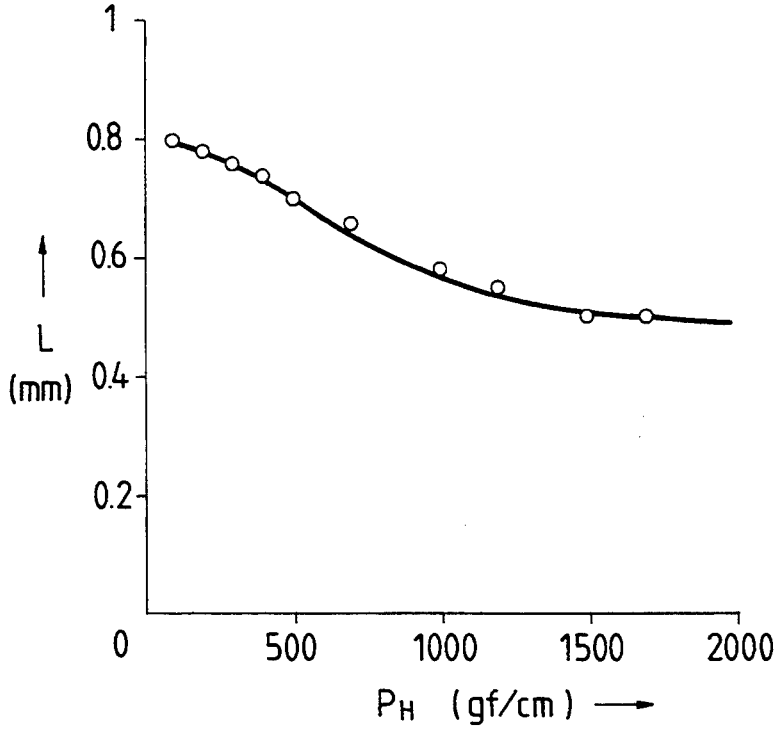
FIG. 19 is a graph showing extension of ink.

As is apparent from FIG. 18 and FIG. 19, it can be understood that the length L of ink extension and the sharpness S of the image edge portion are correlated with each other, and the sharpness S is lowered as the ink length is longer to make the image quality lower, while on the contrary, the sharpness S becomes higher as the ink extension is shorter to improve the image quality.

The length L of the above ink extension differed slightly depending on the smoothness of the recording paper, but the tendency relative to the head pressure $P_H$ was common to all the three kinds of papers.

(3) Ink density

Figure 20:
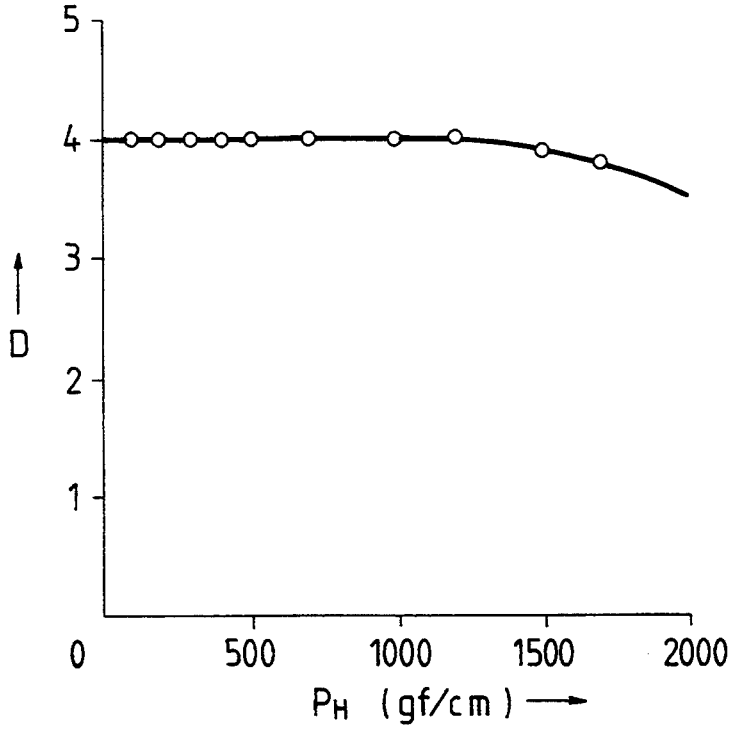
FIG. 20 is a graph showing ink concentration.

Under the respective head pressures $P_H$ as mentioned above, recording was performed on the bonded paper A, and subjective evaluations were done for the ink density D of the transferred image to give the results as shown in FIG. 20.

Evaluation in FIG. 20 was conducted with the evaluation when the head pressure was 300 gf/cm being made 4.

As is apparent from FIG. 20, when the head pressure $P_H$ became the above 1200 gf/cm or higher, there occurred the phenomenon that the fibers of the paper appeared on the surface and the apparent ink density D was lowered.

(4) Damage of recording paper

Under the respective head pressure $P_H$ as mentioned above, recording was performed on the respective recording papers, and it was examined whether the respective papers were damaged. As the result, no damage was seen on the respective papers up to the head pressure $P_H$ of 1200 gf/cm.

Even when the head pressure $P_H$ was made 1500 gf/cm, no damage was seen on the bonded papers A, B, but slight denaturation was observed on the embossed paper.

Further, when the head pressure $P_H$ was increased to 1700 gf/cm, denaturation was seen on the respective recording papers.

(5) Overall evaluation

To summarize the evaluations (1) to (4) as described above, evaluation as shown in FIG. 21 can be done.

Figure 21:
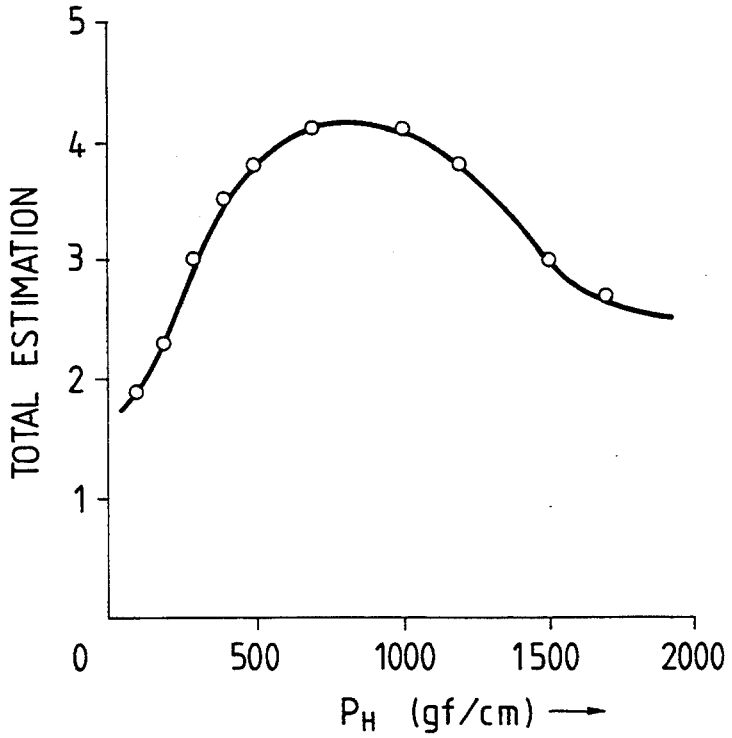
FIG. 21 is a graph showing overall evaluation of the transferred image versus head pressure.
Figure 22:
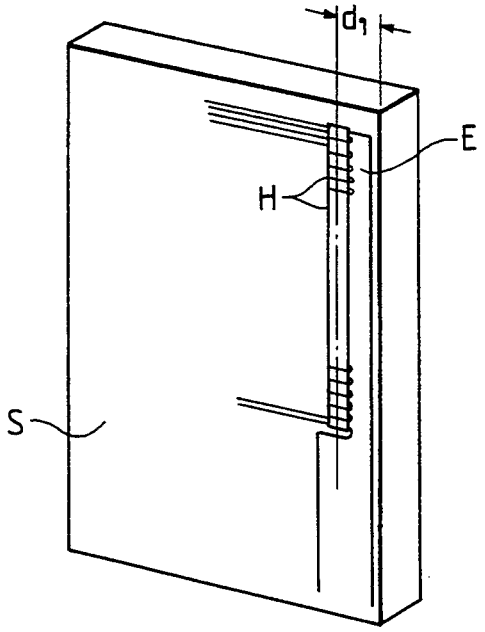
FIG. 22 PRIOR ART
FIGS. 22 and FIG. 23 are illustrations of the prior art.
Figure 23:
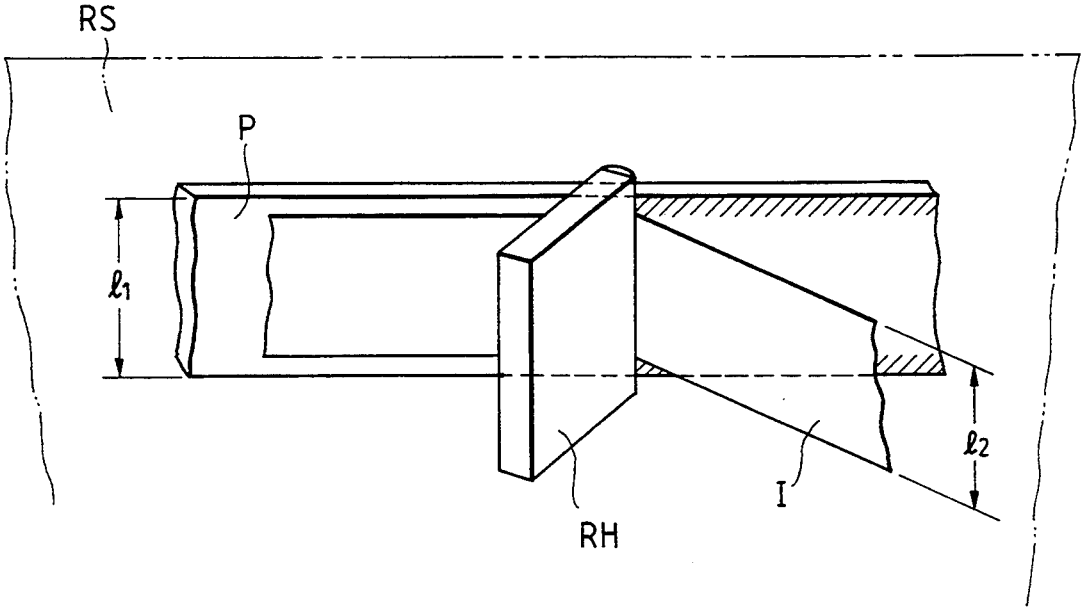
FIG. 23 PRIOR ART

As is apparent from FIG. 21, by setting the head pressure $P_H$ for the heat-generating element array at 300 gf/cm to 1500 gf/cm, it can be appreciated that good transferred image can be obtained even on a recording paper with low surface smoothness.

Further, by setting the above head pressure $P_H$ at the range of 450 gf/cm to 1100 gf/cm, it can be appreciated that considerably good transferred image including the point of image density can be obtained.

Further, by setting the above head pressure $P_H$ at 600 gf/cm to 1100 gf/cm, it can be appreciated that the best transferred image can be obtained.

The resin which becomes the main component of the heat transferable ink of the ink ribbon is not limited to those used in the embodiment as described above, but otherwise acrylic resins, low molecular weight polyester resins, urethane resins, styrene-acrylic resins, polyamide resins, etc. can be also preferably used.

As the support, not only polyethylene film used in the first embodiment as described above, but also polyethylene terephthalate film and others can be preferably used.

In the present embodiment, as described above, by carrying out recording by pressing an ink composed mainly of a resin under a high head pressure within a specified range by a recording head having an array of heat-generating elements provided on the substrate side edge surface, good transfer recording of image can be effected even on an image-receiving medium with low smoothness.

Also, by making the width of the above heat transfer medium wider than the length of the above head pressing the platen, recording can be performed stably without damaging the image-receiving medium.

The recording means as described in the above respective embodiments is not limited to a head having a plurality of heat-generating elements as the above recording head, but, for example, the so called current passage head which passes current to the electrode internally of the ink ribbon, etc. may be also included.

As described above, according to the present invention, clear images can be recorded also on an image-receiving member with low smoothness.

We claim:

1. A thermal transfer recording device which performs recording by heating a thermal transfer medium to transfer an ink possessed by said thermal transfer medium onto an image-receiving medium, thereby effecting recording on said image-receiving medium, said device having:

a platen;

recording means for recording on said image-receiving medium by heating said thermal transfer medium and having a plurality of heat-generating elements;

pressing means for pressing said recording means against said platen with a pressing force, said pressing force being between about 800 gf/cm to 3500 gf/cm;

winding means for winding said thermal transfer medium by applying a winding force thereto; and control means for changing said winding force applied to said thermal transfer medium to wind said thermal transfer medium, said winding force being changed in accordance with said pressing force of said pressing means.

2. A thermal transfer recording device according to claim 1, wherein said recording means presses said thermal transfer medium and said image-receiving medium against said platen.

3. A thermal transfer recording device according to claim 1, wherein said heat transfer medium comprises a heat thermal transferable ink containing a resin.

4. A thermal transfer recording device according to claim 1, wherein said heat transfer medium comprises a thermal transferable ink containing an ionomer resin.

5. A thermal transfer recording device according to claim 1, wherein said pressing means for pressing said recording means against said platen sets said pressing force during recording at between about 1100 gf/cm to 2500 gf/cm.

6. A thermal transfer recording device according to claim 1, wherein said pressing means for pressing said recording means against said platen sets said pressing force during recording at between about 1600 gf/cm to 2500 gf/cm.

7. A thermal transfer recording device according to claim 1, wherein said pressing means for pressing said recording means against said platen sets said pressing force at between about 1100 gf/cm to 2500 gf/cm during recording.

8. A thermal transfer recording device according to claim 1, wherein said pressing means for pressing said recording means against said platen sets said pressing force at between about 1600 gf/cm to 2500 gf/cm during recording.

9. A thermal transfer recording device as in claim 1 wherein said ink comprises an ionomer resin in which a co-polymer comprising $\alpha$-olefin, such as ethylene, propylene and $\alpha,\beta$-unsaturated carboxylic acid, is neutralized with a metal ion.

10. A thermal transfer recording device as in claim 1 wherein said ink comprises about 5–70% of an ionomer resin.

11. A thermal transfer recording method for recording by heating a thermal transfer medium having an ink to transfer said ink onto an image-receiving medium, thereby effecting recording on said image-receiving medium, in a device having a recording means for recording having a plurality of heat-generating elements and a platen, comprising the steps of:

recording on said image-receiving medium by heating said thermal transfer medium using said heat-generating elements;

pressing said recording means against said platen with a pressing force, said pressing force being between about 800 gf/cm to 3500 gf/cm;

winding said thermal transfer medium by applying a winding force thereto; and changing said winding force applied to said thermal transfer medium to wind said thermal transfer medium, said winding force being changed in accordance with said pressing force.

12. A thermal transfer recording method as in claim 11 wherein said ink comprises an ionomer resin in which a co-polymer comprising $\alpha$-olefin, such as ethylene, propylene and $\alpha,\beta$-unsaturated carboxylic acid, is neutralized with a metal ion.

13. A thermal transfer recording method as in claim 11 wherein said ink comprises about 5–70% of an ionomer resin.

14. A thermal transfer recording method according to claim 11, wherein said pressing force is between about 1100 gf/cm to 2500 gf/cm.

15. A thermal transfer recording method according to claim 11, wherein said pressing force is between about 1600 gf/cm to 2500 gf/cm.

16. A thermal transfer recording method according to claim 11, wherein said thermal transfer medium comprises a heat transferable ink containing a resin.

17. A thermal transfer recording method according to claim 11, wherein said thermal transfer medium comprises a heat transferable ink containing an ionomer resin.

18. A thermal transfer recording apparatus for transferring ink of an ink sheet onto a recording medium, thereby recording an image thereon, said apparatus comprising:

a platen;

recording head supporting means for supporting a recording head having a plurality of heat generating elements;

pressing means for pressing said recording head supporting means against said platen with a pressing force, said pressing force being between about 800 gf/cm to 3500 gf/cm;

winding means for winding said ink sheet by applying a winding force thereto; and control means for changing said winding force applied to said ink sheet to wind said ink sheet, said winding force being changed in accordance with said pressing force of said pressing means.

19. An apparatus according to claim 18, wherein said pressing force is between about 1100 gf/cm to 2500 gf/cm.

20. A thermal transfer recording apparatus for transferring ink of an ink sheet onto a recording medium, thereby recording an image thereon, said apparatus comprising:

a platen;

recording head supporting means for supporting a recording head having a plurality of heat generating elements;

pressing means for pressing said recording head supporting means against said platen with a predetermined pressing force;

winding means for winding said ink sheet by applying a winding force thereto; and control means for changing said winding force applied to said ink sheet to wind said ink sheet, said winding force being changed in accordance with said pressing force of said pressing means.

21. An apparatus according to claim 20, wherein said pressing force is between about 800 gf/cm to 3500 gf/cm.

22. An apparatus according to claim 20, said pressing force is between about 1100 gf/cm to 2500 gf/cm.

* * * * *

UNITED STATES PATENT AND TRADEMARK OFFICE

CERTIFICATE OF CORRECTION

PATENT NO. : 5,451,984

DATED : September 19, 1995

INVENTOR(S) : Makoto Takamiya et al.

It is certified that error appears in the above-identified patent and that said Letters Patent is hereby corrected as shown below:

COLUMN 1

Line 30, "presses" should read --pressing--

COLUMN 3

Line 67, "casette 1" should read --cassette 1--

COLUMN 6

Line 25, "set" should read --be set--

COLUMN 7

Line 23, "In the following," should read --Shown below are--

COLUMN 12

Line 16, "give" should read --given--
Line 36, "set" should read --be set--

UNITED STATES PATENT AND TRADEMARK OFFICE

CERTIFICATE OF CORRECTION

PATENT NO. : 5,451,984

DATED : September 26, 1995

INVENTOR(S) : Makoto Takamiya et al.

It is certified that error appears in the above-identified patent and that said Letters Patent is hereby corrected as shown below:

COLUMN 21

Line 52, "heat" should read --thermal--
Line 53, "thermal" should be deleted
Line 55, "heat" should read --thermal--
Line 56, "thermal" should read --heat--

COLUMN 22

Line 9, "claim 1" should read --claim 1,--
Line 14, "claim 1" should read --claim 1,--
Line 37, "11" should read --11,--
Line 42, "11" should read --11,--

COLUMN 24

Line 16, "said" should read --wherein said--

Signed and Sealed this

Twelfth Day of March, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,451,984

DATED : September 19, 1995

INVENTOR(S) : Makoto Takamiya et al.

It is certified that error appears in the above-identified patent and that said Letters Patent is hereby corrected as shown below:

Column 1, line 30, "presses" should read --pressing--.
Column 3, line 67, "casette 1" should read --cassette 1--.
Column 6, line 25, "set" should read --be set--.
Column 7, line 23, "In the following," should read --Shown below are--.
Column 12, line 16, "give" should read --given--.
Column 12, line 36, "set" should read --be set--.
Column 21, line 52, "heat" should read --thermal--.
line 53, "thermal" should be deleted.
line 55, "heat" should read --thermal--.
line 56, "thermal" should read --heat--.
Column 22, line 9, "claim 1" should read --claim 1,--.
line 14, "claim 1" should read --claim 1,--.
line 37, "11" should read --11,--.
line 42, "11" should read --11,--.

UNITED STATES PATENT AND TRADEMARK OFFICE

CERTIFICATE OF CORRECTION

PATENT NO. : 5,451,984

DATED : September 19, 1995

INVENTOR(S) : Makoto Takamiya et al.

It is certified that error appears in the above-identified patent and that said Letters Patent is hereby corrected as shown below:

Column 24, line 16, "said" should read --wherein said--.

This Certificate of Correction Supersedes Certificate of Correction issued the Twelfth Day of March, 1996.

Signed and Sealed this

Fifteenth Day of October, 1996

*Attest:*

Bruce Lehman

BRUCE LEHMAN

*Attesting Officer*

*Commissioner of Patents and Trademarks*